US009005145B2

(12) United States Patent
Champsaur

(10) Patent No.: US 9,005,145 B2
(45) Date of Patent: Apr. 14, 2015

(54) MUSCLE AND/OR JOINT EXERCISE APPARATUS

(76) Inventor: Marc Champsaur, Saint Hilaire de Brethmas (FR)

( * ) Notice: Subject to any disclaimer, the term of this patent is extended or adjusted under 35 U.S.C. 154(b) by 734 days.

(21) Appl. No.: 13/132,668

(22) PCT Filed: Dec. 11, 2009

(86) PCT No.: PCT/FR2009/052489

§ 371 (c)(1),
(2), (4) Date: Jul. 18, 2011

(87) PCT Pub. No.: WO2010/067034

PCT Pub. Date: Jun. 17, 2010

(65) Prior Publication Data

US 2011/0275480 A1 Nov. 10, 2011

(30) Foreign Application Priority Data

Dec. 11, 2008 (FR) ..... 08 58483

(51) Int. Cl.
*A61H 1/00* (2006.01)
*A61H 1/02* (2006.01)
(Continued)

(52) U.S. Cl.
CPC ..... *A63B 21/0058* (2013.01); *A63B 24/0006* (2013.01); *A63B 24/0075* (2013.01); *A63B 71/0622* (2013.01); *A63B 2024/0012* (2013.01); *A63B 2071/0625* (2013.01); *A63B 2071/0655* (2013.01); *A63B 2220/10* (2013.01); *A63B 2220/20* (2013.01); *A63B 2220/24* (2013.01); *A63B 2220/30* (2013.01); *A63B 2220/40* (2013.01); *A63B 2220/51* (2013.01); *A63B 2220/54* (2013.01); *A63B 2220/62* (2013.01); *A63B 2220/72* (2013.01);
(Continued)

(58) Field of Classification Search
USPC ..... 482/1–9; 601/5, 23, 33
See application file for complete search history.

(56) References Cited

U.S. PATENT DOCUMENTS

| | | | | |
|---|---|---|---|---|
| 7,963,887 | B2 * | 6/2011 | Ozawa et al. | 482/8 |
| 8,545,420 | B2 * | 10/2013 | Einav et al. | 601/5 |
| 2003/0028130 | A1 * | 2/2003 | Wunderly et al. | 601/5 |

(Continued)

FOREIGN PATENT DOCUMENTS

| | | | |
|---|---|---|---|
| FR | 2619723 | A | 3/1989 |
| FR | 2875140 | A1 | 3/2006 |
| WO | 2004096501 | A2 | 11/2004 |

OTHER PUBLICATIONS

International Search Report PCT/FR2009/052489; Dated Jul. 22, 2010.

*Primary Examiner* — Loan H Thanh
*Assistant Examiner* — Sundhara Ganesan
(74) *Attorney, Agent, or Firm* — Cantor Colburn LLP

(57) ABSTRACT

An apparatus of muscle and/or joint exercise adapted to reeducation and/or physical conditioning of a body part of a user, including a hollow body;

a mobile member translatable inside the body; a motor-driven means arranged on the bottom of the body and adapted for driving and decelerating in displacement the mobile member in both translatory directions; a cooperating means between the body and a frame, this cooperating means being arranged on the bottom of the body and including: at least one hinge of the body on the frame, the hinge providing at least at least one degree of rotational freedom for the body around an axis of rotation; and a removable means for installing and removing the body, the removable means being designed for removably installing the body on a base slidingly mounted in the frame.

13 Claims, 18 Drawing Sheets

(51) Int. Cl.

| | |
|---|---|
| ***A63B 24/00*** | (2006.01) |
| ***A63B 21/005*** | (2006.01) |
| ***A63B 71/06*** | (2006.01) |

(52) U.S. Cl.
CPC ..... *A63B 2220/74* (2013.01); *A63B 2220/75* (2013.01); *A63B 2225/20* (2013.01); *A63B 2225/50* (2013.01)

(56) References Cited

U.S. PATENT DOCUMENTS

| | | | | |
|---|---|---|---|---|
| 2007/0066451 | A1 | 3/2007 | Gruben | |
| 2007/0202992 | A1 | 8/2007 | Grasshoff | |
| 2007/0232467 | A1* | 10/2007 | Puzey | 482/112 |
| 2007/0299371 | A1 | 12/2007 | Einav | |
| 2009/0119030 | A1* | 5/2009 | Fang et al. | 702/41 |

* cited by examiner 521
23
51
519
522
520
501
24

A
524
50
500
523
525

3
2
521
51
519
520
501
522

518
519
517
500
501
31
24
32
50

23
518
32
517
50
519
24
500

516
514
515
32
4
A
31

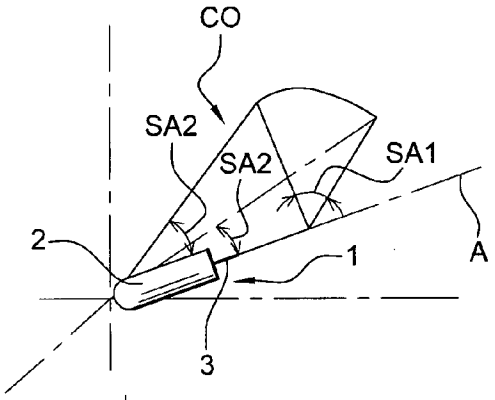
Fig. 10
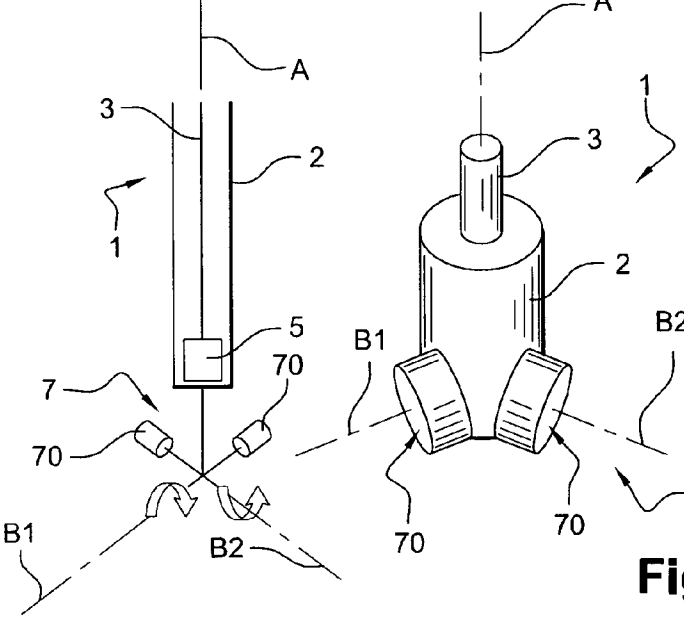
Fig. 12
Fig. 13
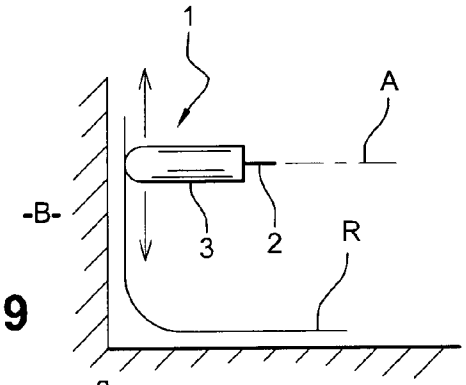
Fig. 9
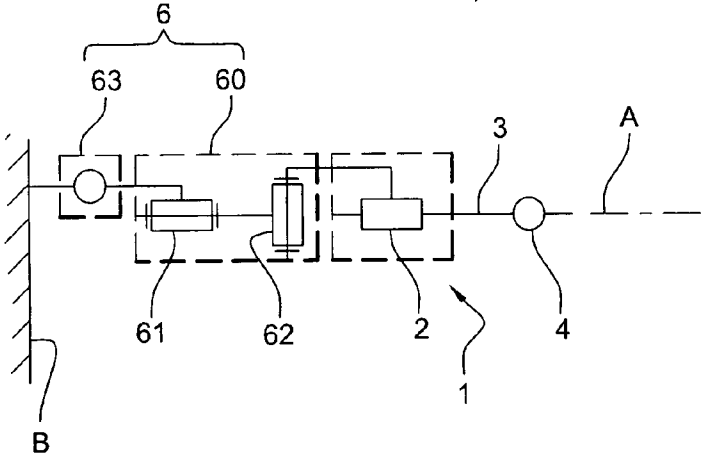
Fig. 11

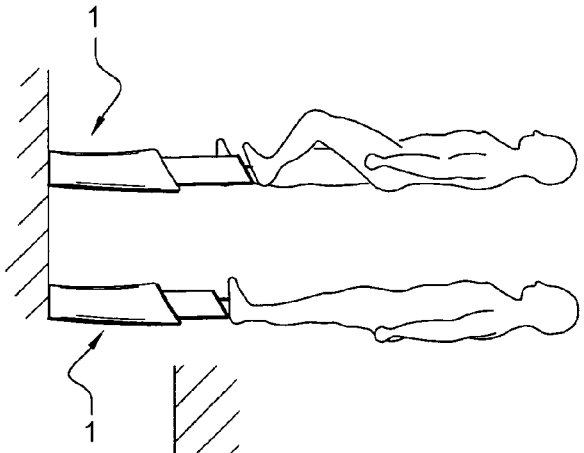
Fig. 42
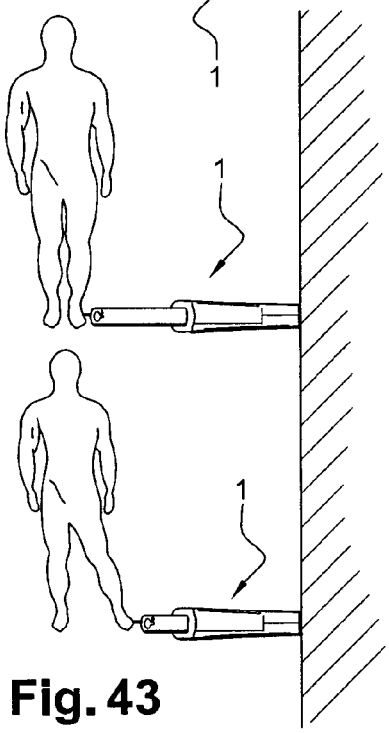
Fig. 43
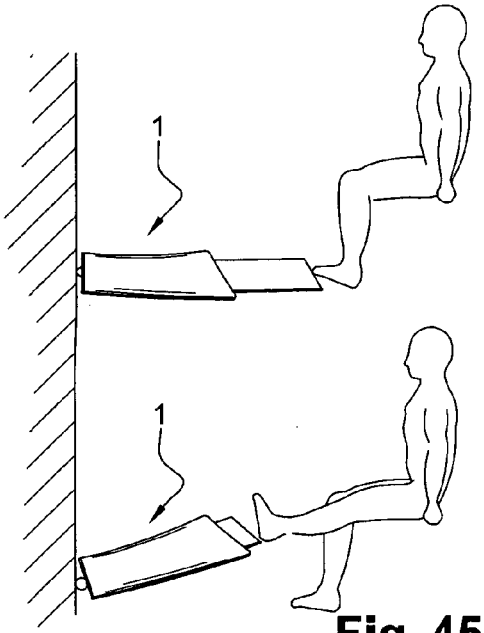
Fig. 45
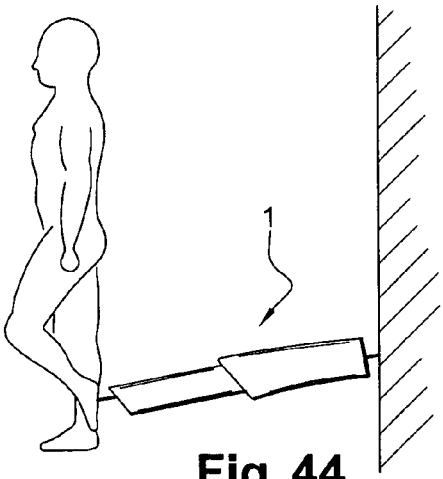
Fig. 44
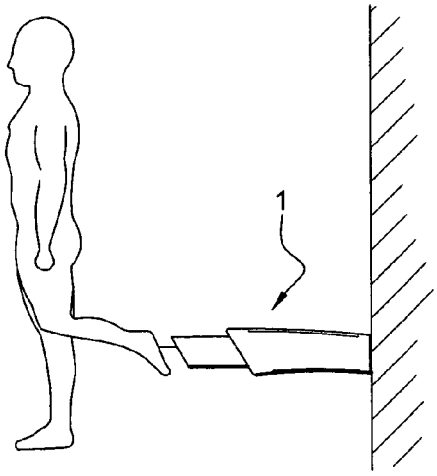

MUSCLE AND/OR JOINT EXERCISE APPARATUS

TECHNICAL FIELD

This invention relates to muscle and/or joint exercise apparatus, a muscle and/or joint exercise device comprising such an exercise apparatus, and a method for using the exercise apparatus; such an apparatus being adapted for physical reeducation and/or training of a body part of a user, such as an upper limb (arm) and/or a lower limb (leg), or part of an upper limb part (forearm, wrist, elbow) and/or lower limb (ankle, thigh, knee), or another body part, such as for instance the hip or pelvis.

More particularly, it relates to a muscle and joint exercise apparatus, which may advantageously be used in a hospital, a physiotherapy practice, a sports club, a fitness club, or at the user's home, wherein a user is any person likely to make use of such an exercise apparatus.

BACKGROUND

In a known manner, the reeducation of a limb, be it an arm or a leg, subsequently to illness or an accident, mainly comprises the following steps:

- a first articular mobilization, during which the limb is moved without involving the patient's muscle, after a period of joint rest with immobilization of the relevant limb;
- an active mobilization, during which the effort of the patient's muscle is assisted; and finally
- muscle strengthening as such, during which the patient will move the limb against a resisting force, possibly including a phase of analytical body building, i.e. involving just one or several specific muscles, followed by a phase of global body building.

In sports and fitness clubs, people generally do muscle exercises which are rarely carried out in day-to-day life, except for sportspeople who, in addition to maintaining their physical condition, will practice the development of specific muscles required for their sport activity, such as arm and leg muscles for a skier, a swimmer, or a tennis player.

Usually, muscle exercises are distinguished depending on the stresses and movements imposed on the muscle, such as:

- isometric body building exercises, with contraction of the muscle without movement of the limb;
- constant weight body building exercises during which a heavy weight is moved vertically by a set of cables and pulleys, more or less rapidly depending on the person's effort;
- isokinetic body building exercises, during which the speed of movement is specified by a machine at a constant value; and finally
- isotonic body building exercises requiring exercise apparatuses specifying a counter-reacting force and speed of movement so that the tonus of the muscle involved remains constant.

Also, knowing that all limbs have two muscles or muscle chains working in opposition, one being the agonist and the other being the antagonist (such as for instance biceps and triceps for the arm, or quadriceps and hamstring muscles for the leg), four distinct muscle efforts can be defined for a limb with reference to lever, such as for instance for the forearm:

- contraction of the biceps for pulling the lever in a concentric movement;
- effort of the biceps for holding back the lever which is moving in an eccentric movement;

- the triceps pushing the lever in an eccentric movement; and finally
- the triceps holding back the lever which is moving concentrically.

Furthermore, it is well known that muscles, due to the asymmetric orientation of the fibers and insertions thereof, apply to the bones and the joints thereof simultaneous bidirectional, or even multidirectional forces and/or torques. Thus, nearly all muscles apply multidirectional stresses to articular segments. Yet, it is has been found that during a muscle exercise developing bidirectional or even multidirectional efforts, the overactivation of the muscle activity may reach 15 to 25% of muscle motor units recruited in addition to a muscle exercise developing unidirectional efforts; a motor unit being defined as a set comprising a muscle fiber and a nervous fiber ensuring control thereof. In the invention, the terms bidirectional or multidirectional express the possibility for a subject, a limb, one or more joints, to be able to perform simultaneously or successively an effort according to several degrees of freedom, thus in several directions, as will be shown more in detail below.

From all of the definitions mentioned above, the large variety of muscle exercises as well as the multitude of possible movements can be understood, which explains the interest for multipurpose muscle exercise apparatuses which allow in particular to ensure multidirectional efforts or movements, to exercise specific muscles or muscle chains without exercising e.g. the antagonist muscle or muscle chains, to enable concentric and eccentric movements.

It is also interesting to have a joint exercise apparatus allowing for articular mobilization in which the limb is moved without involving the patient's muscle, as well as active mobilization active in which the effort of the patient's muscle is assisted.

In order to create an exercising effort on the limb, existing products in the field of reeducation and fitness essentially use systems using weights (a so-called pulley therapy apparatus), or else resistors with pneumatic systems (a so-called mechanical therapy apparatus). Such apparatuses are generally heavy and cumbersome, can hardly be parameterized, offer a reduced choice of movement for the limb, are difficult to self-install and difficult to transport.

Such apparatuses have the disadvantage of suddenly stressing the limbs subjected to the exercise. FIG. 1 represents a curve C0 illustrating the variation of the effort F as a function of the displacement D of the weight, for an up/down displacement cycle of the weight, in the specific case of a pulley therapy apparatus: the first part P1 of the curve, situated above the x-axis, corresponds to a tractive effort, in which the patient or user will pull to lift the weight, and the second part P2 of the curve, situated below the x-axis, corresponds to a retaining (or resisting) effort, in which the patient retains the weight pulled during the first phase. FIG. 1 illustrates the three sudden variations or discontinuities in the effort when:

- lifting the weight up, before the first phase P1;
- inverting the direction of displacement of said weight, between the two phases P1 and P2, where the tractive effort switches to a resisting effort;
- putting the weight down, after the second phase P2.

Such discontinuities are inevitable, not adjustable, and the stronger the heavier the weight to lift or retain. And yet, such sudden variations in effort will generate large stresses at:

- tendons, possibly leading to tendinitis issues in case of fatigue; and
- joints, limiting the use of such apparatuses for people with joint problems, but still wishing to train the muscles of the relevant limb.

Furthermore, such sudden variations in effort put heavy strain on the cardiac system, because the heart must respond to this sudden muscle effort. Thus, people having cardiac weaknesses, as for instance people bearing pacemakers, cannot use such apparatuses, or only in a very limited way.

During the stage of the first phase P1 of displacement, the tractive effort F of the machine will remain practically constant for the entire displacement. During this first phase P1, it is to be observed that respiration adjusts substantially to the pace of the movements, which does not necessarily coincide with the normal respiration rate. Therefore, this respiration will not allow for correct supply of oxygen, and the muscle will exercise in anaerobia, in other words with a deficit of oxygenation. Such a deficit of muscle oxygenation creates toxins which will have to be evacuated, so as to avoid stiffness, by means of stretching at the end of the exercise, and by greater hydration.

During this first phase P1, straining of all muscle fibers is also to be observed. As the effort F is constant during the entire first phase P1 of weight displacement, all fibers are exercising. Such straining of all fibers may be harmful for people with muscle contusions on certain fibers, so that training of this muscle cannot be carried out with such an exercise apparatus. For these persons, only a specialist, as for example a physiotherapist, may specifically exercise certain muscles or muscle chains, namely by varying the effort in the course of the movement. Also, these apparatuses are not adapted for persons having a weakened and/or painful tendon and who can exercise their limb only in a limited movement range of the relevant limb.

After the weight has been pulled during the first phase P1, it must then be brought back to the starting point in the second phase P2. Returning the weight is thus mandatory and the resisting effort to be performed is equivalent to the tractive effort. All of the comments above regarding the first phase P1 are of course applicable to the second phase P2.

These constant and repeated efforts of traction and resistance will indeed apply efforts on the limb being exercised, but will also strain the patient's posture holding muscles. E.g., in case the patient is seated and is performing movements with only one arm, his/her torso will compensate for the loss of balance generated by the efforts applied to the arm. During the exercise, the patient's compensation will not be identical all the time, and his/her posture may deviate, with the risk of generating long term muscle issues.

Moreover, the known muscle training apparatuses are generally not multipurpose or multifunctional in that such apparatuses have hinges specifically dedicated to exercising certain muscles or certain limbs or parts of a limb, such as an arm, a shoulder, an elbow, a wrist, a thigh, an ankle, etc.

The state of the art may also be illustrated by the teaching of the documents FR 2 875 140 A1 and FR 2 619 723 A1. These documents disclose apparatuses for training and reeducating the lower limbs, and in particular the knee for FR 2 875 140 A1, using rotationally mobile members. Such apparatuses and systems have the disadvantage of being cumbersome and difficult to transport, not to mention that they are limited to exercising the lower limbs, or even only to exercising the knee, by using such a rotationally mobile member.

So-called multi-use apparatuses are also known, which can perform several functions successively, in addition to two distinct devices. However, such apparatuses cannot simultaneously perform bidirectional or multidirectional movements or efforts in that they do not allow for bidirectional or multidirectional movements or efforts to be carried out simultaneously.

In the field of reeducation of people suffering from movement disorders, it is known from WO 2004/096501 to use an exercise apparatus comprising a piston which is mobile inside a cylinder under the effect of a hydraulic or pneumatic unit. However, such an apparatus turns out to be expensive and not well suited for certain types of movement, namely due to the inherent inertia of a displacement controlled by a hydraulic or pneumatic unit. It is known from this document WO 2004/096501 to use an exercise apparatus of the type of a robot arm or with return force requiring pneumatic, hydraulic, or motorized control with coupled motors. However, such an apparatus is particularly complex and expensive, and it only allows to exercise in one predefined plane specified by the apparatus.

US 2007/0202992 A1 describes an exercise apparatus comprising a rotationally mobile crank, the rotational displacement of which is regulated around of an effort set-point curve. Such an apparatus turns out to be cumbersome, difficult to transport, and not suitable for certain types of movement due to the limitation of the movement to a simple rotation of the crank.

US 2007/0299371 A1 discloses an exercise apparatus designed for guiding a patient in carrying out a movement along a determined spatial path. In particular, this apparatus comprises a telescopic arm limited in terms of movement amplitude and is thus intended for learning small amplitude gestures. Thus, this apparatus is not well suited for articular reeducation which requires much greater possibilities of amplitude. Moreover, this telescopic arm is limited in terms of radial efforts due to the mechanical design thereof. Indeed, this telescopic arm is not well suited for taking over too forceful radial efforts, and thus limits the exercises to very weak radial efforts. This apparatus is thus not well suited for muscle strengthening exercises which require great efforts. The barycenter of this apparatus largely varies during operation, thus requiring compensating mechanisms which are particularly expensive, complex and cumbersome, i.e. mechanisms for regulating the motors and the tow bar brake.

Furthermore, the apparatus described in US 2007/0299371 A1 is a solution with four degrees of mobility of which at least three are motorized which is particularly expensive and cumbersome, especially with a work table, and thus limited to reeducation centers, like clinics or hospitals. The space requirement of the work table also prevents spatial exercise.

In the field of reeducation of the lower limbs, US 2007/0066451 A1 discloses an exercise apparatus comprising a pedal which can be displaced under the effect of the patient's foot. With such an apparatus, the exercise is performed in a plane which cannot be parameterized and along a fixed path within the same series of repetitions of the exercise, thus limiting the use thereof to a very limited number of exercises.

BRIEF SUMMARY OF THE INVENTION

The invention is intended to solve all or part of the above-mentioned disadvantages, and to propose for this purpose a muscle and/or joint exercise apparatus adapted to the physical reeducation and/or training of a body part, in particular an upper and/or lower limb, of a user, said apparatus comprising:

- a hollow body, open at one of the ends thereof and having a bottom at the end opposite the open end;
- a mobile member translatable inside the body along a main axis and designed to be displaced by the body part of the user and also to displace said body part;
- a motor-driven means arranged on the bottom of the body, connected to the mobile member and adapted for driving in displacement the mobile member in both translatory directions, and also for braking the displacement of the mobile member in both translatory directions;

a cooperating means between the body and a frame, this cooperating means being arranged on the bottom of the body and comprising:

at least one hinge of the body on the frame, said hinge providing at least one degree of rotational freedom for the body around an axis of rotation; and a removable means for installing and removing the body, said removable means being designed for removably installing said body on a base slidingly mounted in the frame.

This apparatus has the advantage of being lightweight and compact, transportable or portable, mainly comprising the hollow body, the motor-driven means, and the mobile member. The space required for such an apparatus is substantially the space required for the body, when the arm is retracted at least partially inside the body; the motor-driven means being advantageously fastened to the bottom of the body, inside or outside the body. Thus, this apparatus is easy to transport by hand or in a car, e.g. enabling a therapist or a sports trainer to move around with one or several apparatuses in accordance with the invention and visit his/her patients or clients to make them do exercises on these apparatuses.

Positioning the motor-driven means and the cooperating means on the bottom of the body thus allows for the barycenter to be stabilized at the back of the apparatus, and thus shift the weight of the apparatus at the frame with the advantage of minimizing weight changes in operation, during exercises. Advantageously, the motor-driven means is arranged inside a case integral with the body, and the cooperating means is fastened to the relevant case, so that the cooperating means is arranged substantially between the removable means and the motor-driven means.

Furthermore, this apparatus is suitable for performing simultaneously bidirectional or multidirectional movements or efforts, by allowing for an effort to be made according to several degrees of freedom. Indeed, the mobile member provides a first degree of freedom in relation to the body, and the hinge provides at least one additional degree of freedom. Thus, the apparatus may be used in reeducation (or fitness) of most of the patient's muscles.

Furthermore, the user may choose the exercise plane by adjusting the position of the body on the frame, due to the removable means allowing for the body to be removably mounted on a base which is adjustable in translation on a frame.

By combining the mobility in translation of the mobile member, the degree(s) of rotational freedom obtained by the hinge, and the possibility of adjusting the position (e.g. height or vertical position) of the apparatus, multiple combinations and movements can be envisaged for the patient, with the patient being for instance in a lying, seated, or standing posture, and with the apparatus (in other words the body of the apparatus) being positioned in a horizontally or vertically adjustable way, or else inclined. Thereby, with this apparatus it is possible for the user to exercise almost in half a space of about −90° to +90° horizontally and about −90° to +90° vertically.

This apparatus advantageously allows to carry out exercises in aerobics. With this apparatus, it is indeed possible to work out with maximum effort during one part of the exercise and thus avoid modeling expiration on the effort and adjust respiration to the exercise and consequently heart rhythm to respiration. Consequently, respiration and heart rhythm are disconnected from the effort. The gas exchanges (oxygen supply to the muscle) are therefore optimized, thus allowing for exercises to be carried out without any substantial need for prior cardiovascular warm up. This apparatus thus enables people incapable of doing prior warm up to practice physical conditioning and/or reeducation. Furthermore, the toxins generated during efforts are also drained from the muscle more efficiently, thus avoiding a subsequent need for muscle stretching after exercises, while avoiding next day traumas such as stiffness. Thereby, this apparatus enables people incapable of doing cardiovascular warm up before the exercise and/or stretching after the exercise to practice this type of physical conditioning and/or reeducation.

Among other advantages, this apparatus allows to exercise a single muscle chain without the antagonist muscle chain being weight stressed during the exercise. Indeed, the apparatus can provide energy, or resist to energy, in one direction of displacement of the mobile member and make sure to return to the home position without the user having to produce any effort. With such a workout it is possible to exercise a muscle or muscle chain precisely without weight straining the muscles of the antagonist chain, thereby making the practice of physical conditioning and/or reeducation available in particular for people with muscle traumas or joint, tendon or bone issues.

Of course, this apparatus can be programmed for straining several muscles and also involve several muscle chains during the same exercise. It can thus be envisaged with this apparatus to exercise antagonist chains, in view of balancing, muscle buildup, or even time savings.

The apparatus in accordance with the invention can have two operating modes:

a drive or active mode, in which the apparatus generates a movement which the user is to resist. Energy is provided by the motor-driven means according to predefined setpoint curves, such as for instance effort or speed curves, and the user provides a resisting counter-effort, thereby enabling him/her to exercise one part of these muscles.

a generating or resisting or passive mode, in which the apparatus applies a preprogrammed counter-effort against the movement made by the subject, thereby providing energy.

Advantageously, the hinge is designed to offer two degrees of rotational freedom around respectively two axes of rotation, namely perpendicular to each other; one of the axes of rotation coinciding with the main axis of translation.

For example, the hinge comprises a first pivot link along the main axis, connected to a second pivot link along a transverse axis perpendicular to the main axis.

Preferably, the or each hinge further comprises at least one adjustable stop limiting the rotation of the body around at least one axis of rotation, so that said stop allows to define an angular range adjustable for the rotation of said body around the corresponding axis of rotation.

By comprising such an adjustable stop, the hinge can limit the rotation of the body around the axis of rotation involved and thus define an angular range for the rotation around the corresponding axis of rotation, so as to limit the movement of the body part of the user within a certain angular sector, or even within a given cone of freedom when two degrees of rotational freedom are limited.

According to one option of the invention, the body supports at least one secondary motor-driven means adapted for rotatingly driving the body around an axis of rotation, said secondary motor-driven means comprising at least one angle sensor around the axis of rotation thereof.

The or each angle sensor can be connected to a control means for controlling the or each secondary motor-driven means so as to force the body part of the user to follow a delimited path, wherein said angle sensor may be associated with a displacement sensor of the mobile member so that the mobile member can be located in space; with the control means allowing to perform a step of steering the path of the mobile member in space.

Of course, it can be envisaged to have two secondary motor-driven means connected to the control means and adapted for rotationally driving the body around two respective axes of rotation; with these axes being for instance perpendicular to each other. Also, it is possible to have three secondary motor-driven means connected to the control means and adapted for rotationally driving the body around three respective axes of rotation. It is also possible to have at least one secondary motor-driven means adapted for rotationally driving the body around an axis of rotation, as well as at least one other secondary motor-driven means adapted for translationally driving the body.

According to one characteristic, the apparatus comprises a connecting means adapted for connecting said body part of the user to said mobile member so that the user may impose an effort of displacement on said mobile member and vice versa.

According to another characteristic, the connecting means corresponds to one of the means selected from a spherical handle, a ball handle, a swivel handle, a belt, a gripping surface made at one end of the mobile member, and any other equivalent gripping means allowing for both pulling and/or pushing of the mobile member.

In general, the connecting means is adapted to the body part to exercise, so that it is of advantage for the connecting means to be interchangeable. Thus, the connecting means is removably fastened to the mobile member in order to allow for interchangeability thereof.

In particular, the apparatus allows for exercises to be carried out namely on the lower and upper limbs, without for example exclusively using one or the other limb. With this apparatus it is also possible to carry out workout exercises on other parts of the body (pelvis, back . . . ), e.g. by means of a belt.

According to another characteristic, the motor-driven means comprises:

- a motor intended for four-quadrant operation;
- a reversible supply of the motor; and
- reversible means for converting the output movement of the motor into a translatory displacement of the mobile member.

Advantageously, on the inside, the body supports means for guiding the mobile member so as to sustain the radial efforts perpendicular to the main axis and for guiding said mobile member in the translatory movement thereof.

Thus, the apparatus allows for muscle strengthening exercises requiring great efforts to be carried out.

In a specific version, such guiding means comprise:

- several tie bars, preferably three tie bars, extending inside the body in parallel to the main axis; and
- at least one slide, slidingly mounted on each of said tie bars and fixedly mounted on the mobile member.

With these tie bars, guiding the mobile member is substantially isostatic, thereby ensuring optimal pick-up of the radial efforts and enabling the apparatus to sustain large radial efforts.

In this version with tie bars, it can be envisaged that the motor-driven means comprises a rotary motor, a threaded shaft rotatingly driven by the motor and a nut part fastened to the mobile member and equipped with a threaded orifice cooperating with the threaded shaft, and that the nut part is integral with the slide.

E.g., the body has a length comprised between 700 and 1500 mm, preferably between 1000 and 1200 mm.

E.g., the mobile member has a maximum translatory stroke comprised between 500 and 1000 mm, preferably between 700 and 800 mm.

In a specific version, the apparatus further comprises a display means adapted for performing a step of displaying the progress of the main exercise parameter and/or of at least one set-point parameter during the exercise in order to inform the user and/or a third party of the progress of this or these characteristic parameter(s) of the exercise carried out by the user, said display means being namely made as a screen or monitor or an array of LEDs arranged on the apparatus or outside the apparatus.

Thereby, this display allows for real-time follow-up of the work produced by the user, either for a third party practitioner or sports trainer wishing to monitor the current exercise, so as to possibly modify the exercise along the way depending on the curves displayed by the display means.

Advantageously, the apparatus further comprises a transmission means adapted for performing a step of transmitting data representing the progress of the main exercise parameter and/or at least one set-point parameter during the exercise for an external terminal, namely of the type of a telephone and/or computer terminal, so as to inform a third party situated at a distance from the user of the progress of this or these characteristic parameter(s) of the exercise carried out by the user, said transmission means being namely of wire transmission or wireless transmission type.

Thus, a person situated at a distance (such as a practitioner or sports trainer) can receive via a network a history of the exercise carried out by the user, thereby allowing for progress of the user to be followed session by session and possibly for the exercise to be adapted to the user, by modifying or replacing the set-point curve and/or the entire exercise protocol.

According to one characteristic, the apparatus further comprises at least one user guiding means, adapted for generating a guiding signal, namely of the visual signal, haptic, or audible type, for the user and intended to guide the user in the exercise namely in terms of:

- effort or speed to produce for displacing the mobile member or decelerating the displacement of the mobile member;
- time or number of cycles remaining for the exercise or for the corresponding exercise phase.

This guiding means thus enables the user to be guided in his/her exercises, either visually (e.g. with a screen positioned in front of him/her) and/or audibly (e.g. with a speaker emitting pre-recorded phrases), by issuing written or spoken phrases of information type (such as for instance: "five minutes left" or "slow down") or of the type intended to encourage the user (as for example "you are going to break your record").

The apparatus is for instance fitted with integrated man-machine interfaces (such as a screen, a keyboard, a voice synthesizer, a microphone, etc.) and with communication peripherals (such as a touch screen, a computer, etc.) which allow for inputting or recording of the set-point curves and for data transfer before and after the exercise. Thereby, the user and his/her immediate or remote environment may also be provided in real time with sound data, visual data, and graphs during the exercises.

The invention also relates to a muscle and/or joint exercise device adapted for reeducation and/or physical conditioning of a body part, namely an upper and/or lower limb, of a user, said device comprising:

an exercise apparatus in accordance with any of the preceding items; and a frame inside which a base is slidingly mounted;

wherein the body is removably mounted on said base, via the removable means, so that the position of the apparatus may be adjusted by adjusting the position of the base on the frame.

Such a device is particularly advantageous because the combination of such a frame and such an apparatus allows for the workout plane to be selected from an infinite number of solutions. Indeed, this device allows for workout in a complete half-space, limited by the frame supporting the base.

The apparatus and the device in accordance with the invention allow for the upper limbs, the lower limbs, and also the torso (working the spine) to be exercised with one and the same apparatus.

The invention also relates to a method for using an exercise apparatus in accordance with the invention, comprising the following steps:

removably installing the body of the apparatus on a base sliding mounted within a frame;

adjusting the position of the apparatus by adjusting the position of the base on the frame.

According to one option of the invention, this method of use further comprises a method for controlling the apparatus, comprising the following steps:

a) recording or inputting at least one set-point curve corresponding to a predefined variation of a predetermined main exercise parameter as a function of a status parameter such as time or displacement of the mobile member, said exercise parameter representing the effort of displacement imposed by the mobile member on said body part or vice versa, and namely selected from the force produced by the user on the mobile member for displacing or decelerating the mobile member, the torque or force produced by the motor-driven means for displacing or decelerating the mobile member, the speed of displacement of the mobile member, and the acceleration of the displacement of the mobile member;

b) acquiring an actual curve corresponding to the variation of the main exercise parameter measured during the exercise as a function of the status parameter;

c) controlling the motor-driven means so as to regulate the actual curve around the set-point curve during the exercise, said motor-driven means being controlled for displacing and/or decelerating the mobile member in a translatory movement.

Thereby, this method controls a mobile member displaced or decelerated in translation by regulation, so that linear movements can be carried out according to a predefined set-point curve. The regulation essentially aims at the actual curve approximating the set-point curve, with a certain tolerance; said set-point curve corresponding to an objective to be reached by the user, during the exercise, in terms of effort during the displacement of the mobile member. The mobile member is capable of pushing and pulling the limb, and also of resisting to an effort applied by the body of the user on the mobile member in the two directions of displacement; during a cycle (displacement with return to the starting point) the main exercise parameter may vary according to the adjustment.

Programming the effort thus gives the possibility of having a multifunctional apparatus, wherein the same method (or apparatus) can be used for instance for all of the user's limbs, lower and upper, and other body parts (hip, pelvis, etc.). Moreover, programming the effort provides many physiological advantages for the user: the set-point curves (as for example effort or speed curves as a function of the displacement of the mobile member) can be entirely programmed or parameterized by the user or by a practitioner, such as a physiotherapist, or by a sports trainer.

Thus, as mentioned below, programming the effort in particular allows for:

working out in aerobics;

avoiding sudden variations in effort during the exercise, thereby removing sudden strains for tendons, joints, and the heart;

working on desired muscles or muscle chains, by targeting the effort on one or several selected muscle chains, with the others ones, which are not strained, resting;

exercising two clearly distinct muscle chains in the same movement.

With this control method and the associated apparatus in accordance with the invention, it is possible to carry out exercises statically and dynamically. Among the main exercise parameters (as for example effort and speed) and status parameters (as for example time and displacement of the mobile member), each one can, alone or in combination with another parameter, be programmed or canceled within an exercise. In the specific case where the displacement is fixed at a predefined value (in other words the case where the position of the mobile member is fixed), the exercise corresponds to static workout because the user will produce an effort, or resist an effort, so that the point of contact of his/her body and the mobile member will be immobile in space. In other instances, the exercises correspond to dynamic workout with a displacement of the mobile member in relation to the user's body.

In an advantageous version, the control method further comprises the following steps:

d) during the exercise, measuring at least one set-point parameter selected from:

a secondary exercise parameter distinct from the main exercise parameter, said secondary exercise parameter representing the effort of displacement imposed by the mobile member on said body part or vice versa and namely selected from the force produced by the user on the mobile member for displacing or decelerating the mobile member, the torque or force produced by the motor-driven means for displacing or decelerating the mobile member, the speed of displacement of the mobile member, and the acceleration of the displacement of the mobile member; and/or a physiological parameter representing the physiological state of the subject and selected namely from electromyographic activity, respiration rate, heart rhythm, temperature of the user, blood oxygen level, blood pressure, and perspiration; and/or a duration parameter representing the duration of the exercise and namely selected from the duration of the exercise, the number of displacement cycles carried out by the mobile member, the time required for the user to carry out one or several predetermined displacements of the mobile member; and/or an environmental parameter representing the external environment in which the user is carrying out the exercise, and namely selected from external ambient temperature, external level of humidity, external ambient pressure;

e) during the exercise, comparing the at least one set-point parameter with at least one predefined threshold value, namely of the type of a minimum threshold value or maximum threshold value, wherein said comparison can namely be carried out for a predetermined period of time and/or a predetermined portion of the displacement of the mobile member;

f) modifying or replacing the set-point curve if, in step e), at least one set-point parameter is greater or smaller than the corresponding threshold value, before returning to steps b) to e) with the set-point curve as modified or replaced so as to adapt the exercise to the user according to an exercise protocol predefined depending on the progress of at least one set-point parameter.

Thus, the exercise may change along the way, with for instance different series of successive workout cycles (each series being associated with a specific set-point curve), e.g.:

- adapting to the user (who may grow tired and wish to reduce the effort or to the contrary wish to increase the effort); and/or
- working different muscles or muscle chains in the same exercise; and/or
- working different joints in the same exercise;
- selectively carrying out isometric, isokinetic, or isotonic body building exercises.

In this case, the control method allows for modifying the exercise (by modifying or replacing the set-point curve) or stopping the exercise, e.g. in case of fatigue or weakness of the user; this being a so-called auto-adaptive exercise method (or apparatus) because the exercise will adapt automatically to the user according to a pre-established setup protocol.

In order for the exercise to adapt to the user and so that the apparatus may carry out steps d) to f) of the control method, this apparatus may comprise:

- a storage or input means adapted for recording or inputting the at least one set-point curve in step a) of the method;
- at least one first means for measuring the first main exercise parameter and at least one second means for measuring the status parameter;
- at least one third means for measuring the at least one set-point parameter so as to perform step d) of the method; and
- a control means connected to the first and second measuring means, the motor-driven means and the storage or input means, said control means being designed for:
  - acquiring the actual curve from measures carried out by the first and second measuring means so as to perform step b) of the method;
  - controlling the motor-driven means so as to perform step d) of the method;
  - performing comparison step e); and
  - performing step f) of modifying or replacing the set-point curve.

In a first example, the set-point curve(s) may be effort (or counter-effort) curves as a function of the displacement of the mobile member or of time. In this case, the regulation of the motor-driven means ensures that the main effort or counter-effort parameter is kept, and the speed of the mobile member is a resultant taken into account so as to ensure an operating range or to display or record the data; the speed here being a predetermined set-point parameter.

In a second example, the set-point curve(s) can be speed curves of the mobile member as a function of the displacement of the mobile member or of time. In this case, the motor-driven means ensures that the main speed parameter is kept, and the effort is a consequence, the measurement of which ensures an operating range and can be displayed or recorded; the effort here being a predetermined set-point parameter.

According to one characteristic, the control method comprises a step of receiving at least one order issued by the user or a third party, and a step of modifying or changing the set-point curve depending on said order so as to modify the current exercise or replace the current exercise with another exercise.

This step of modifying or replacing the set-point curve is of the same type as step f) described above; the only difference being the origin (or starting point) of the step, i.e. the receipt of a set-point issued by a person in this case and a variation of a set-point parameter in the case of step f). It is to be understood that it can be envisaged for these two steps to be performed in parallel.

Thus, a practitioner, such as a physiotherapist or sports trainer, can intervene in the exercise by forcing the control means to modify the exercise, the aim being for example to adapt the exercise depending on the user placed under the observation of the practitioner or sports trainer. Also, the user himself/herself may modify the exercise along the way as a function of his/her physical impressions regarding the current exercise.

The apparatus can thus comprise a means for receiving an order adapted for performing a receiving step in accordance with the control method.

The user as well as the therapist or sports trainer can thus intervene in real time during an exercise to modify one or several parameters, as for example effort or speed as the main exercise parameter. Thereby, the user has complete control over his/her exercises and can adapt them deliberately within the same unitary movement, namely so as to accelerate, increase force, add iterations or time, lengthen or shorten a displacement (i.e. increase or reduce the amplitude of a translatory movement of the mobile member) and have the modification taken into account in real time.

Preferably, an exercise protocol defines several phases of successive exercises:

- a first phase in which:
  - i) steps b) and c) are performed with a first set-point curve ($C_C$10), for a determined number of displacement cycles of the mobile member (3) or for a predetermined duration;
  - ii) steps d) and e) are performed in step i) with a determined set-point parameter ($P_C$);
  - iii) step f) is performed when the determined number of displacement cycles has been carried out by the mobile member (3) or the predetermined duration has expired, by replacing the first set-point curve ($C_C$10) with a second set-point curve ($C_C$20) or by modifying the first set-point curve ($C_C$10) so as to define a second set-point curve ($C_C$20), and under the condition that the set-point parameter ($P_C$) is smaller or greater than a determined threshold value;
- a second phase following the first phase in which:
  - iv) steps b) and c) are performed with the second set-point curve ($C_C$20) for a determined number of displacement cycles of the mobile member (3);
  - v) steps d) and e) are performed in step iv) with one or several determined set-point parameters ($P_C$);
- vi) step f) is performed in steps iv) and v) if one of the set-point parameters ($P_C$) examined in step v) is greater or smaller than a determined threshold value, by replacing the second set-point curve ($C_C$20) with another set-point curve or by modifying said second set-point curve ($C_C$20).

Thereby, this exercise protocol allows for exercising the body part of the user with at least two pre-established distinct phases; these phases being characterized namely by the associated set-point curves which have been recorded or input maybe by a practitioner, such as a physiotherapist, or a sports trainer, depending on the pathology to be treated and/or the training adapted to the user.

Training may thus comprise a programmed movement according to a given set-point curve, in turn repeated according to a defined number of iterations (or cycles). Certain parameters of this initial exercise can progress as a function of one or several selected set-point parameters. Multiple exercises of different types can be combined within the same exercise protocol; the complete exercise protocol can be represented in a control algorithm. The conditions of chaining one exercise after another exercise and the number of exercise cycles may depend on the predetermined set-point parameter(s).

In a specific embodiment, an exercise protocol defines at least one exercise phase in which, for a determined number of displacement cycles, the motor-driven means is controlled for, in each cycle:

having the user work out in a single direction of translation of the mobile member, the so-called working direction, between a home position and an end position with regulation around a predefined set-point curve; and automatically displacing the mobile member in the direction of translation opposed to the working direction, up to the home position, so as not to have the user work out in this direction of translation;

steps b) to f) being possibly performed during this exercise phase.

With such an exercise protocol, the user works his/her body part in a single direction of translation, thereby allowing for a specific muscle chain to be worked, without working the antagonist muscle chain. Such a protocol can also be intended for more specifically working a joint of an upper or lower limb.

In a particularly advantageous version, the set-point curve (as recorded or input or possibly as replaced or modified) corresponds to the predefined variation of the predetermined main exercise parameter as a function of the displacement of the mobile member, said variation being performed only within a predetermined range of displacement between a predetermined minimum value and maximum value of the displacement.

With such a set-point curve, an exercise protocol defines an exercise phase in which the motor-driven means is controlled for displacing the mobile member according to a predefined set-point curve only within a selected range of displacement of the mobile member. In this phase, the mobile member does not move over the entire stroke thereof (i.e. between the retracted position and the deployed position), but moves over a reduced stroke, conventionally between two intermediate positions associated with corresponding minimum and maximum values.

Thus, it is possible to limit the displacement of the body part of the user between two boundaries selected namely depending on the muscles and/or joints to be trained or not and also depending on the user's pathologies. In a first sample exercise, this exercise protocol allows for a series of small rapid displacements of a user's limb to be carried out, i.e. displacements over a small amplitude stroke in relation to the total stroke of the mobile member, so as to exercise muscle tonus. In a second sample exercise, it is possible to work a joint (as knee, elbow, shoulder joints, etc.) within a predetermined angular sector; the angular sector being defined from minimum and maximum values of the displacement of the mobile member.

Advantageously, the control method comprises a step of locating the mobile member in space, and a step of steering the position of the mobile member in space so as to oblige the user during the exercise to follow a path delimited in space, with the mobile member.

Thus, the control method and the associated apparatus allow to control the motor-driven means and the secondary motor-driven means in order to regulate the movement of the mobile member around a predefined path, allowing for the body part of the user (generally an upper or lower limb) to be worked in space, with the advantage of working specific muscle chains, according to a selected program or exercise protocol.

BRIEF DESCRIPTION OF THE DRAWINGS

Other characteristics and advantages of the invention will be apparent from reading the detailed description hereafter of several non-restrictive sample implementations, with reference to the appended figures in which:

FIG. 9 schematically illustrates an apparatus in accordance with the invention engaged in a guiding rail integral with a frame;

FIG. 10 schematically illustrates an apparatus in accordance with the invention in connection with a frame and free to move inside of a predefined truncated cone;

FIG. 11 schematically represents the various links of an apparatus in accordance with the invention;

FIGS. 12 and 13 are schematic views of an apparatus in accordance with the invention equipped with secondary motor-driven means;

FIGS. 38 to 45 each illustrate a user of an apparatus in accordance with the invention in two situations where the mobile member respectively is in the retracted and deployed position, each figure corresponding to a distinct exercise on a given limb of the user;

DETAILED DESCRIPTION

The description of the invention comprises mainly three parts, including:

- a first part specifically dedicated to the exercise apparatus in accordance with the invention and the structural characteristics thereof;
- a second part more specifically related to the control method in accordance with the invention; and
- a third part regarding use the apparatus and the method in accordance with the invention.

The first part of the description related to the structure of the apparatus in accordance with the invention is given below.

The invention relates to an exercise apparatus 1 adapted for reeducation and/or physical conditioning of a user's body part, such as an upper and/or lower limb. This apparatus 1 is adapted for exercising both the upper and lower limbs of the user, as well as other parts of the body, such as the hips or pelvis. Furthermore, this apparatus 1 is also designed for carrying out muscle and joint exercises of the relevant limb.

Figures 1, 2, 3A, 3B, 3C, 3D, 4A, 4B:
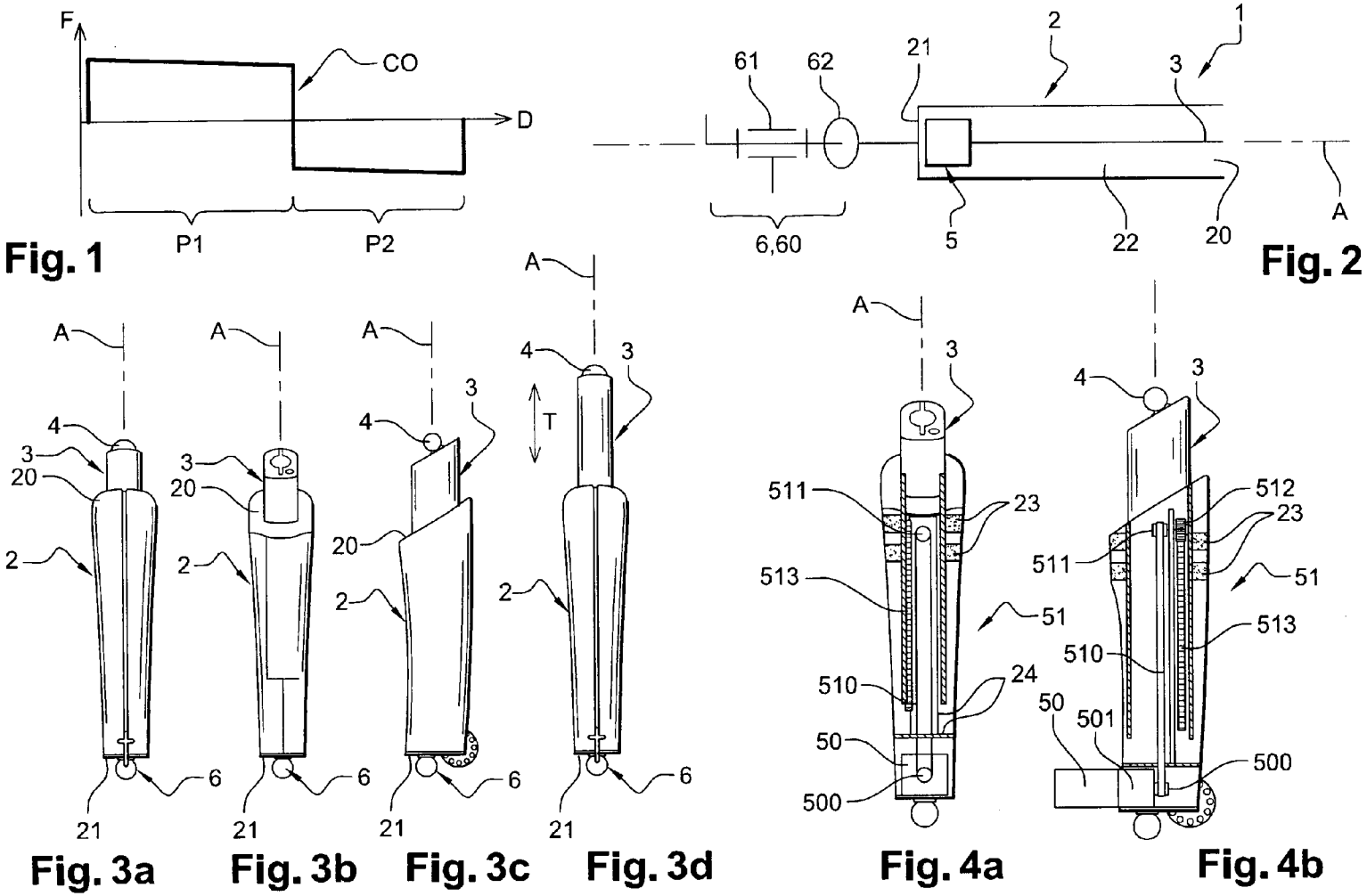
FIG. 1 represents a curve C0 illustrating the variation of the effort F as a function of the displacement D of the weight, for an up/down displacement cycle of the weight, in the case of a known pulley therapy apparatus.
FIG. 2 schematically represents an apparatus in accordance with the invention.
FIGS. 3*a* to 3*c* respectively are back, front, and side views of an apparatus in accordance with the invention with a mobile member in the retracted position.
FIG. 3*d* is a back view of this apparatus with the mobile member in the deployed position.
FIGS. 4*a* and 4*b* respectively are front and side views of the inside of an apparatus in accordance with the invention illustrating a motor-driven means according to a first embodiment.

Referring to FIGS. 2 and 3, this apparatus 1 comprises:

- a hollow body 2, which is open at one of the ends thereof 20 and extends along a main axis A;
- a mobile member 3, hereafter called arm, which is translatable inside the body 2 along the main axis A and goes through the open end 20 of said body 2, said arm 3 being movable between a retracted position illustrated in FIGS. 3*a* to 3*c*, and a deployed position illustrated in FIG. 3*d;*
- a connecting means 4 adapted for connecting one part of the limb of the user to said arm 3 so that said limb can exert an effort of displacement on said arm 3 and vice versa, in other words so that the limb may pull and push the arm 3 and the arm 3 may pull and push the limb;
- a motor-driven means 5 fastened to the body 2 and connected to said arm 3, said motor-driven means 5 being adapted on the one hand, in a drive mode, for driving in displacement the arm 3 in both direction of translations, and on the other hand, in a deceleration mode, for decelerating the displacement of the arm 3 in both direction of translations.

The body 2 is a body which is elongated along the main axis A and has the open end 20 and a bottom 21 on the end opposite the open end 20. Without restriction, the body 2 is made from two half-shells assembled together; these two half-shells are for instance made by plastic molding or by deformation of a metal sheet. On the inside, the body 2 delimits a longish cavity 22.

The body 2 supports a cooperating means 6 between the body 2 and a frame, as for example a gantry, a wall, or the floor, or any other stationary element. This cooperating means 6 is arranged on the bottom 21 at the other end of the body 2 opposite the open end 20.

As can be seen in FIG. 2, the cooperating means 6 comprises a hinge 60 providing the body 2 with two degrees of rotation around respectively two axes of rotation perpendicular to each other, one of the axes of rotation coinciding with the main axis A of the body 2. This hinge 60 comprises for instance a first pivot link 61 along the main axis A connected to a second pivot link 62 along a transverse axis perpendicular to the main axis A. As will be described below, this hinge 60 provides the arm 3 with two degrees of rotation in addition to the degree of freedom in translation, thereby allowing the arm 3 to be oriented in space within a cone of freedom.

As illustrated in FIG. 10, it can be envisaged to limit in part certain degrees of rotational freedom by providing one or two stops for each degree of freedom, each stop limiting the rotation of said body 2 around the corresponding axis of rotation, in other words closing the angles of rotation of the degrees of freedom. Thus, the arm 3 can be oriented in space inside a cone portion CO defined by angular sectors. Consequently, the following can be provided:

- stops for limiting rotation of the first pivot link 61 around the main axis A to an angular sector SA1; and
- stops for limiting rotation of the second pivot link 62 around an axis perpendicular to the main axis A to an angular sector SA2.

These two angular sectors SA1 and SA2 thereby define a portion CO of a cone of freedom for the arm 3. Preferably, the stops can be adjusted or positioned, automatically or manually, in order to adjust the angular sectors SA1 and SA2 in a range comprised between 0 and 360°.

It can also be envisaged for the hinge 60 to provide more than two degrees of freedom (e.g. three) by providing more than two pivot links; the number of pivot links and the orientation of the respective axes of rotation combining so as to delimit a space in which the user can displace the arm 3.

With two stops per pivot link, it is possible to influence the position of said stops so as to define a window (more or less narrow depending on the relative position of the stops) inside which the user may displace the arm 3. Thereby, the user can follow a path in space while remaining within the window defined between the different stops.

Regarding the stops, they can be equipped with a safety system so that, beyond a predetermined effort applied by the user to a stop, the corresponding safety system will trigger and release the stop, i.e. letting the user leave the angular limitation defined by the relevant stop. Such a safety system is advantageously designed to return to the home position, i.e. it is possible to rearm the safety system (once triggered) so that the stop returns to its primary function of angularly blocking the corresponding pivot link.

Such a hinge 60 is also illustrated schematically in FIG. 11, where the cooperating means 6 further comprises a removable means 63 for installation and removal to/from a base, as for example a base (not shown) slidingly and adjustably mounted inside frame B, so as to connect the hinge 60 to the frame B via said removable means 63 and so as to be able to adjust the (vertical or horizontal) position of the apparatus 1 by adjusting the position of this base inside the frame B.

The removable means 63 is fastened to the mobile base and is for instance made as a means for latching, removable embedding, screwing, suction cup means, or any other equivalent means. It is thus possible to fasten the body 2 of the apparatus 1 removably to the mobile base via this removable means 63, so as to be able to install and remove the apparatus 1 rapidly on/from the frame B. In a variant not shown, the hinge 60 and the removable means 63 are in reverse positions, i.e. the removable means 63 is fastened directly to the body 2 while the hinge 60 is fastened directly to the mobile base inside the frame B.

As illustrated in FIG. 9, the cooperating means 6 is slidingly mounted inside a base (not shown) translationally guided in a rail R fastened to the frame B (wall and/or floor) so as to adjust the position of the apparatus 1 with respect to the frame B namely depending on the user's morphology and/or the exercise to be carried out and/or the limb to exercise. Thus, it can be envisaged that the removable means 63 allow for installation and removal on/from this carriage-like base, slidingly mounted inside the rail R integral with frame B.

A muscle and/or joint exercise device in accordance with the invention comprises:

- an exercise apparatus 1 in accordance with the invention; and
- a frame B in which a base is slidingly mounted;

wherein the body 2 of the apparatus 1 is removably mounted on this base, via the removable means 63, so as to allow for the position of the apparatus 1 to be adjusted by adjusting the position of the base on the frame B.

Alternatively, the cooperating means 6 can be fastened to a heavy, cast iron-like weight, or to a gyroscopic inertial mass, and not directly to a frame. When the exercise is finished, the apparatus 1 can be released from the base (frame, heavy weight, carriage, rail, or gantry) and then be stored or transported. It can also be envisaged to motorize the displacement of the apparatus 1 on the rail R so as to ensure automatic positioning of said apparatus 1 in rail R.

The hinge 6 can also be a single ball link having three degrees of rotational freedom.

In FIGS. 3 to 7, the cooperating means 6 is made as a spherical or punctual connecting part. This spherical part may punctually bear on a planar surface, as for example a wall or the floor, thereby providing the apparatus 1 with three degrees of rotation. This spherical part may also engage inside a fixed spherical cage on a frame, thereby providing the apparatus 1 with a pivot link having three degrees of rotational freedom.

The arm 3 is an elongated part slidingly mounted inside the body 2. On the inside, the body 2 supports means for guiding the arm 3 so as to sustain the radial efforts perpendicular to the main axis A and guiding the arm 3 in the translatory movement thereof. E.g., the guiding means comprise rails fastened to the body 2, inside the cavity 22, in which a carriage integral with the arm 3 is sliding.

In order to allow for exercises both of the lower and upper limbs and for the sake of compactness, the body 2 has a length comprised between 700 and 1500 mm, advantageously between 1000 and 1200 mm. For the same reasons, the arm 3 has a maximum translatory stroke comprised between 500 and 1000 mm, advantageously between 700 and 800 mm.

The arm 3 has two opposite ends, namely:

- a first so-called free end 31 and on which the connecting means 4 is arranged so that the user may move the arm 3 in both directions and also so that the arm 3 may move the limb of the user; and
- a second end 32 connected to the motor-driven means 5 so that the motor-driven means may move the arm 3 in both directions and also so that the displacement of the arm 3 may be decelerated by the motor-driven means 5.

In an alternative not shown, the mobile member is made as a telescopic arm.

The connecting means 4 is adapted so that the user's body part can:

- both pull and push the arm 3, pulling of the arm 3 comprising moving the arm 3 from the retracted position to the deployed position, and pushing the arm comprising moving the arm 3 from the deployed position to the retracted position; and/or
- both be pulled and pushed by the arm 3.

The connecting means 4 may adopt different shapes depending namely on the body part to exercise, as for instance:

- a gripping means for a hand, as for example a spherical handle (illustrated in FIGS. 3 to 7), a hinged handle, namely like a ball handle providing several degrees of rotational freedom, or a swivel handle providing only one degree of rotational freedom, or a gripping surface for the hand made on the first end 31 of the arm 3;
- a belt or an attachment for attaching the arm 3 around a body part of the user, as for example a belt surrounding a limb (e.g. at the knee, the ankle, the thigh of a leg, or at the wrist, the elbow, the shoulder of the arm) or another body part (around the pelvis, hip, back, etc.) of the user.

Thereby, it can be envisaged to have several connecting means 4 as accessories of the apparatus 1 to establish the connection between the arm 3 and the different body parts of the user; said connecting means 4 being adapted to the body part (limb or other) to exercise, as for example the elbow, the knee, the hand, the ankle, etc. Thus, the connecting means 4 are removably fastened to the arm 3 so that they can be installed, removed, exchanged and replaced with each other.

Figure 24:
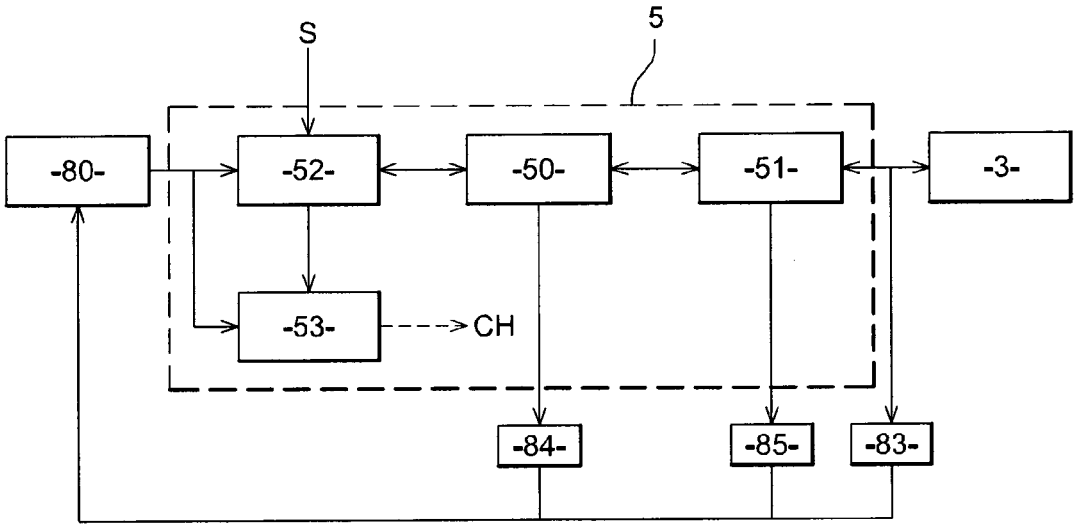
FIGS. 24 to 27 represent different block diagrams of an apparatus in accordance with the invention comprising a motor-driven means according to different embodiments.

In a first implementation of the motor-driven means 5 illustrated in FIG. 24, hereafter called "reversible four quadrants", said motor-driven means 5 comprises:

- a so-called reversible rotary motor 50 provided for four-quadrant operation; and
- reversible means 51 for converting the rotational movement of the rotary motor 50 into a translatory displacement of the arm 3, said converting means 51 thereby allowing for the movement to be transmitted between the output of the motor 50 and the arm 3 and vice versa in both direction of translations of the arm 3.

The reversible rotary motor 50 operates in four quadrants, i.e. it may operate both:

- in a driving mode, also called drive mode, in which the motor 50 drives the arm 3 in translation in one direction of translation or the other; and
- in a decelerating mode, also called regenerating or generating mode, in which the motor 50 decelerates the displacement of the arm 3 in one direction of translation or the other.

Figure 16:
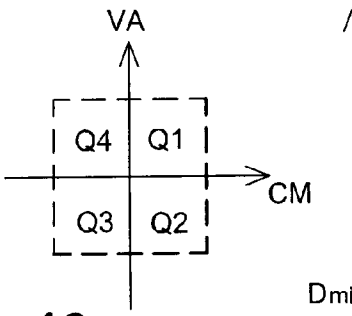
FIG. 16 schematically illustrates the four operating quadrants of a motor-driven means fitting an apparatus in accordance with the invention.

This four-quadrant operation is illustrated in FIG. 16 where the four quadrants are sketched in a graph with as the abscissa the motor torque CM and as the ordinate the angular speed VA at the output of the motor:

- the first quadrant Q1 corresponds to a drive mode in which the speed at the output of the motor and the direction of the motor torque have the same direction of rotation (here clockwise) and in which the motor 50 drives the arm 3 in translation in a first direction of translation, the so-called positive direction, corresponding to a displacement from the retracted position to the deployed position, while the user is not resisting this displacement or even sustaining it by pulling on the arm 3;
- the second quadrant Q2 corresponds to a deceleration mode in which the speed at the output of the motor and the direction of the motor torque have opposite directions of rotation, respectively a counterclockwise direction and a clockwise direction, and in which the arm 3 is moved by the user in the positive direction of translation, i.e. pulled by the user, while the motor 50 is decelerating this displacement;
- the third quadrant Q3 corresponds to a drive mode in which the speed at the output of the motor and the direction of the motor torque have the same direction of rotation (here a counterclockwise direction opposed to the clockwise direction) and in which the motor 50 drives the arm 3 in translation in a second direction of translation, the so-called negative direction, opposed to the positive direction and corresponding to a displacement from the deployed position to the retracted position, while the user is not resisting this displacement or even sustaining it by pushing the arm;
- the fourth quadrant Q4 corresponds to a deceleration mode in which the speed at the output of the motor and the direction of the motor torque have opposite directions of rotation, respectively a clockwise direction and a counterclockwise direction, and where the arm 3 is moved by the user in the negative direction of translation, i.e. pushed by the user, while the motor 50 slows down this displacement.

In this implementation the "reversible four quadrants" of the motor-driven means 5, the motor-driven means 5 possibly comprises a variable speed gear 52 for the motor 150; said variable speed gear 52 being of the reversible electrical type with an equally reversible power supply connected to the mains S. Indeed, the supply 52 must be voltage and current reversible so that in deceleration mode of the motor 50, energy can be dissipated or returned to the mains. The motor 50 is then connected to the arm 3 via the reversible converting means 51.

When the reversible electrical motor 50 is operating in deceleration mode, i.e. when the motor 50 is to exert on the arm 3 a force opposed to the direction of displacement of the arm 3, the motor 50 produces (or generates) an electric current. This electric power thus generated by the motor 50 is for example dissipated as heat through a variable load or resistor 53 to be seen in FIG. 25. Without a power supply, deceleration will not work and therefore, the arm 3 can move freely under the effect of its own weight.

Figure 25:
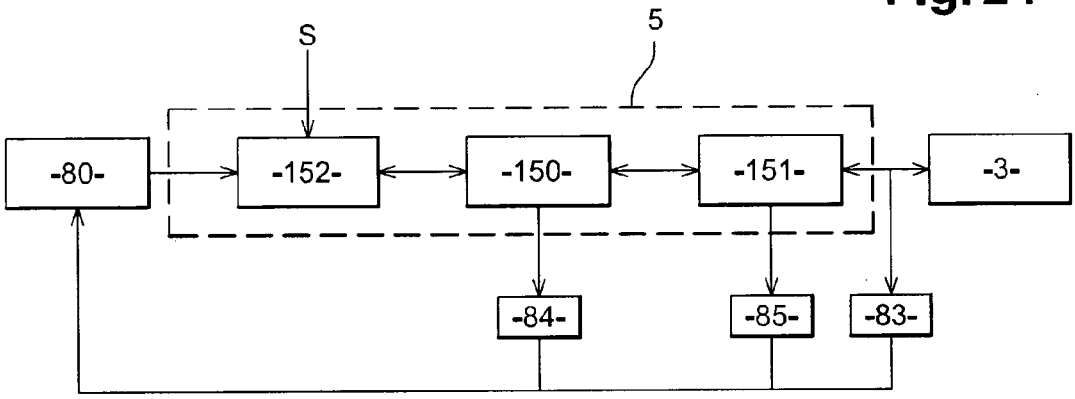

In a second implementation of the motor-driven means 5 illustrated in FIG. 25, hereafter called "reversible two quadrants", said motor-driven means 5 comprises:

- a rotary motor 150 provided for two quadrant operation;
- a variable speed gear 152 for the motor 150, electrically connected to the mains S; and
- reversible means 151 for converting the movement of rotation of the rotary motor 150.

The motor 150 only operates in the two quadrants Q1 and Q3 described above.

In this "reversible two quadrant" implementation of the motor-driven means 5, the generating mode is no longer used with respect to the "reversible four quadrant" implementation, deceleration being carried out by creating a resisting torque inside the motor 150. The principle is thus to create a torque (or force) opposing the rotational displacement of the motor 150 so as to decelerate the movement.

Figure 26:
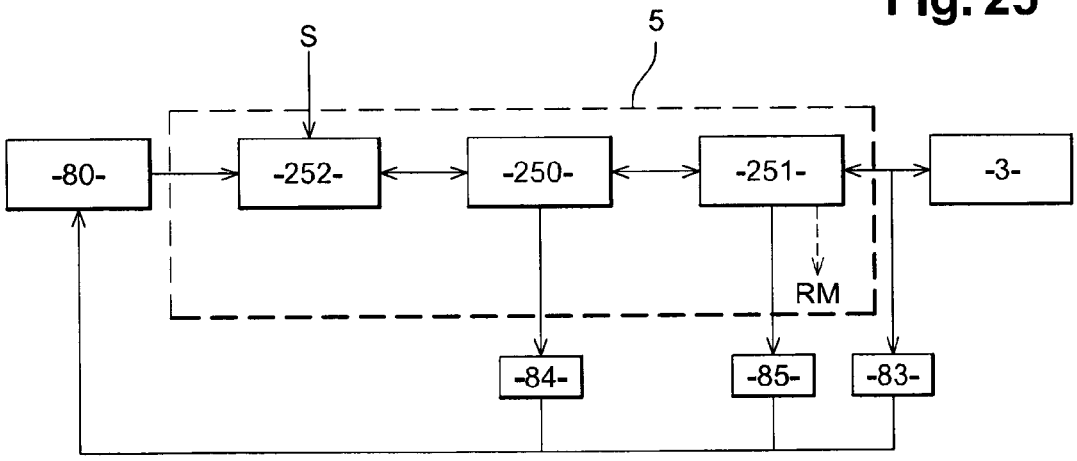

In a third implementation of the motor-driven means 5 illustrated in FIG. 26, hereafter called "irreversible with mechanical friction in conversion", said motor-driven means 5 comprises:

- a non-reversible rotary motor 250 provided for operation in drive mode only and for carrying out to-and-fro displacements without an internal deceleration mode internal of the motor 250;
- a variable speed gear 252 for the motor 250, electrically connected to the mains S; and
- irreversible means 251 for converting the movement of rotation of the rotary motor 250 and provided with means for deceleration by mechanical friction.

In this "irreversible with mechanical friction in conversion" implementation of the motor-driven means 5, the motor 250 always operates in drive mode and the converting means 251 are not-reversible. If an effort is exerted on the arm 3, the mechanical converting means 251 will automatically block the displacement of the arm 3 due to this effort due to internal mechanical friction of the converting means 251, as schematically illustrated by the arrow RM representing the internal mechanical resistance by friction of the converting means 251.

In case the motor-driven means 5 is to create an effort for displacing the arm 3, the motor 250 will have to provide, in addition to the effort required for displacing the arm 3, an additional effort required for overcoming the internal mechanical friction of the converting means 251. In case the motor-driven means 5 is to withstand a displacement of the arm 3, the motor 250 might operate in drive mode so as to assist the external effort exerted on the arm 3. Without a power supply, the arm 3 is blocked in place due to the internal friction of the converting means 251.

Figure 27:
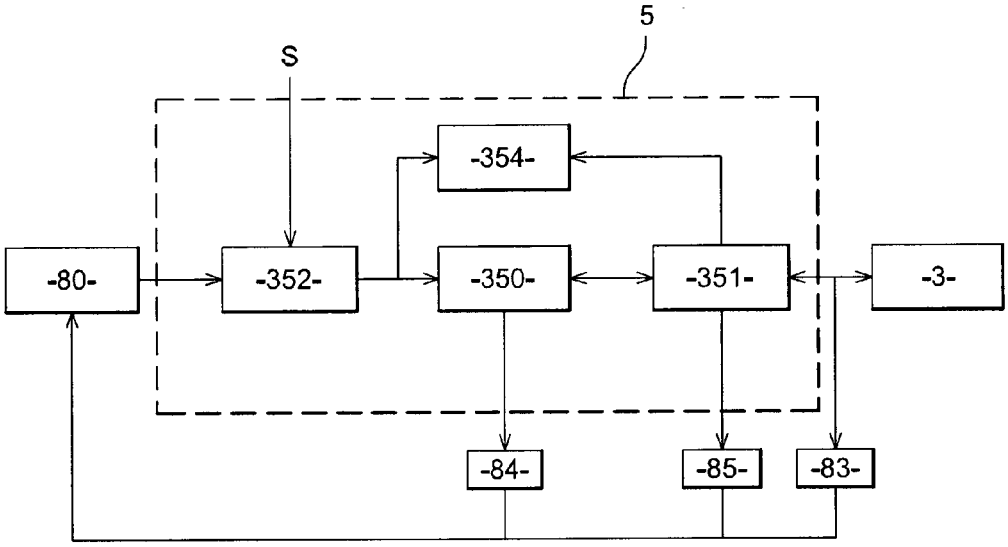
Figure 28:
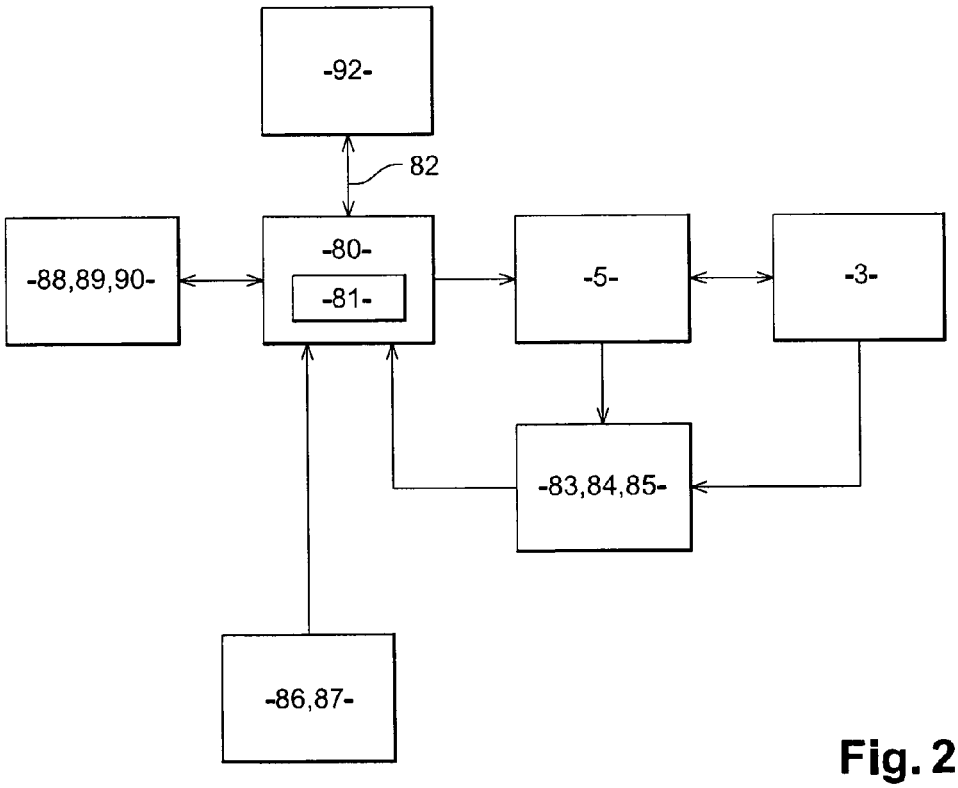
FIGS. 28 to 30 represent different block diagrams of an apparatus in accordance with the invention.

In a fourth implementation of the motor-driven means 5 illustrated in FIG. 27, hereafter called "irreversible with mechanical brake", said motor-driven means 5 comprises:

- a non-reversible rotary motor 350 provided for operation only in drive mode and for performing to-and-fro displacements without an internal deceleration mode of the motor 350;
- a variable speed gear 352 for the motor 350, electrically connected to the mains S;
- irreversible means 351 for converting the movement of rotation of the rotary motor 350; and
- a mechanical brake 354 arranged in parallel to the motor 350 and designed for decelerating the displacement of the arm 3.

In this "irreversible with mechanical brake" implementation of the motor-driven means 5, the motor 350 always operates in drive mode and the converting means 351 are not reversible. In case the motor-driven means 5 are to decelerate the displacement of the arm 3, the motor 350 does not receive any power supply and the mechanical brake 354 will create a counter-effort withstanding the displacement of the arm 3.

The motors 50, 150, 250, 350 may for instance be made as one of the following types of electrical motors:

- DC motor;
- universal motor;
- synchronous motor of the type of a permanent magnet motor, a so-called "brushless" motor, a variable reluctance motor, a stepper motor, a hybrid motor, or a hysteresis motor;
- asynchronous motors of the type of a three-phase squirrel cage motor, a single-phase motor, or a stepper motor;
- a piezoelectric motor;
- DC servomotors;
- asynchronous servomotors;
- a so-called "brushless" permanent magnet servomotor (AC and DC).

FIGS. 4 to 8 illustrate different embodiments of the motor-driven means 5 of the "reversible four quadrant" type adapted for translationally driving the arm 3 and for decelerating the displacement of this arm 3. As can be seen in FIGS. 4 to 7, the arm 3 is an elongated hollow part, open at the second end 32 thereof and translationally guided inside the body 2 via guide shoes 23 fastened inside the body 2 and surrounding the arm 3. The converting means 51 partially extend inside the arm 3.

In the first embodiment illustrated in FIGS. 4*a* and 4*b*, the converting means 51 comprise:

- a belt 510 rotatingly connected to the rotary motor shaft 500 of the motor 50 on the one hand, and to a pulley 511 fastened to a base 24 integral with the body 2 on the other hand, said base 24 partially extending over the length of the body 2 inside the arm 3 and said belt 510 going through said base 24;
- a toothed wheel 512 rotationally integral with the pulley 511 and fastened to the base 24; and
- a rack 513 meshing with the toothed wheel 512 and fastened to the arm 3.

Thus, the rotation of the motor shaft 500 rotatingly drives the pulley 512 via the belt 510, and said pulley 511 rotatingly drives the toothed wheel 512 which by turning translationally displaces the arm 3 via the rack 513. In this embodiment, the motor shaft 500 extends along an axis perpendicular to the main axis A. As illustrated, the motor 50 may protrude from the body 2 via a corresponding opening made in said body 2.

Figures 5, 6A, 6B, 7A, 7B, 8:
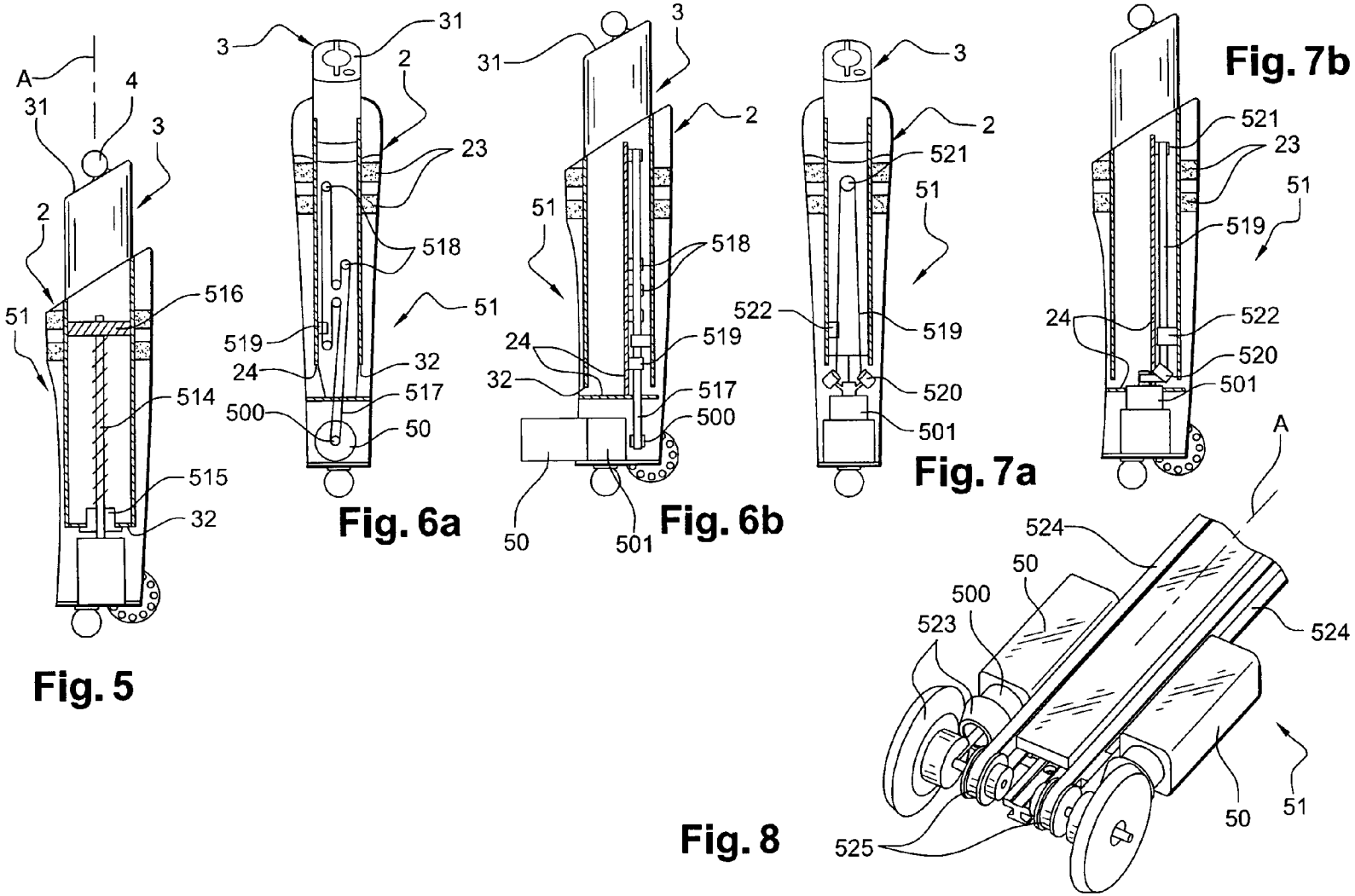
FIG. 5 is a side view of the inside of an apparatus in accordance with the invention illustrating a motor-driven means according to a second embodiment.
FIGS. 6*a* and 6*b* respectively are front and side views of the inside of an apparatus in accordance with the invention illustrating a motor-driven means according to a third embodiment.
FIGS. 7*a* and 7*b* respectively are front and side views of the inside of an apparatus in accordance with the invention illustrating a motor-driven means according to a fourth embodiment.
FIG. 8 is a partial view in perspective of a motor-driven means according to a fifth embodiment.

In the second embodiment illustrated in FIG. 5, the converting means 51 comprise:

- a threaded shaft 514 (e.g. of the ball screw type) rotatingly driven by the motor 50, thereby being the output shaft of said motor 50 and going through the second end 32 of the arm 3 via a bearing 515; and
- a nut part 516 fastened to the arm 3 and equipped with a threaded orifice cooperating with the threaded shaft 514.

Thus, the threaded shaft 514 and the nut part 516 together form a screw/nut system for transforming a rotational movement into a translatory movement: the rotation of the threaded shaft 514 translationally drives the nut part 516 which translationally drives the arm 3. In this embodiment, the threaded shaft 514 extends along the main axis A.

In the third embodiment illustrated in FIGS. 6*a* and 6*b*, the converting means 51 comprise:

- a belt 517 rotationally connected to the motor shaft 500 extending along an axis perpendicular to the main axis A;
- rollers 518 extending along respective axes perpendicular to the main axis A and guiding the displacement of the belt 517 so that said belt has a long planar portion, between two rollers, which is parallel to the main axis A along the arm 3, there being a total of five of said rollers 518 here which are fastened to a base 24 integral with the body 2 and partially extend over the length of the body 2 inside the arm 3;
- a connecting piece 519 integral both with the arm 3 and the long planar portion of the belt 517.

Thus, the rotation of the motor shaft 500 rotatingly drives the belt 517 around the rollers 518, so that the connecting piece 519 is translationally driven between the two rollers 518 delimiting the long planar portion of said belt 517, thereby translationally driving arm 3.

In the fourth embodiment illustrated in FIGS. 7*a* and 7*b*, the converting means 51 comprise:

- a belt 519 rotationally connected to the motor shaft 500 extending along an axis parallel to the main axis A;
- a pulley 520 allowing for a return at right angles of the belt 519 so that said belt has a long planar portion, between the pulley 520 and a roller 521, said pulley 520 and said roller 521 being fastened to a base 24 integral with the body 2 and partially extending over the length of the body 2 inside the arm 3;
- a connecting piece 522 integral both with the arm 3 and the long planar portion of the belt 519.

Thus, the rotation of the motor shaft 500 rotatingly drives the belt 519 around the pulley 520 and the roller 521, so that the connecting piece 522 is translationally driven between the pulley 520 and the roller 521, thereby translationally driving arm 3.

In the fifth embodiment illustrated in FIG. 8, the motor-driven means 5 comprises two rotary motors 50 each with a motor shaft 500 extending along an axis parallel to the main axis A, and converting means 51 comprising for each motor 50:

- two meshing bevel gears 523, the first being rotationally integral with the motor shaft 500 and the second being rotatingly driven by the first bevel gear around an axis perpendicular to the main axis A;
- a belt 524 driven in rotation by the second bevel gear 523 by means of a toothed wheel 525 rotationally integral with this second bevel gear, said belt 524 then translationally driving the arm 3 via known type means.

The motor-driven means 5 can also comprise a speed reducer 501 visible in particular in FIGS. 4*b*, 6*b* and 7*b*. In the fifth embodiment illustrated in FIG. 8, speed reduction can be performed by influencing the transmission ratio between the two bevel gears 523.

Furthermore, the converting means 51 must be easy to displace by the user, preferably with an effort of less than 5 or even 1 Newton, in case the motor 50 is stopped or not operating.

FIGS. 46 to 52 illustrate a preferred embodiment of an exercise device and exercise apparatus in accordance with the invention.

Frame B appears as a vertical gantry having a rail R wherein a base S, made as a slide, is slidingly and adjustably mounted.

The apparatus 1 is removably mounted on this base S.

In a substantially equivalent way to the second embodiment described above with reference to FIG. 5, the motor-driven means 5 comprises:

- a rotary motor 50;
- a threaded shaft 514 (e.g. of ball screw type) rotatingly driven by the motor 50; and
- a nut part 516 fastened to the arm 3 and equipped with a threaded orifice cooperating with the threaded shaft 514.

The apparatus 1 comprises a case 26 fastened to the bottom 21 of the body 2 and into which the rotary motor 50 is mounted.

Figure 48:
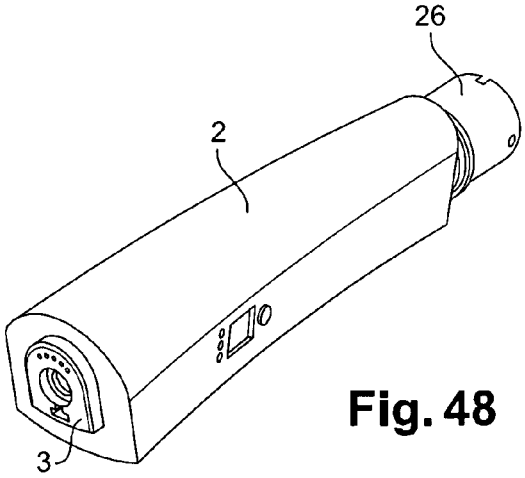
FIG. 48 is a schematic perspective view of the apparatus illustrated in FIGS. 46*a* and 46*b*, without the cooperating means thereof.
Figure 48A:
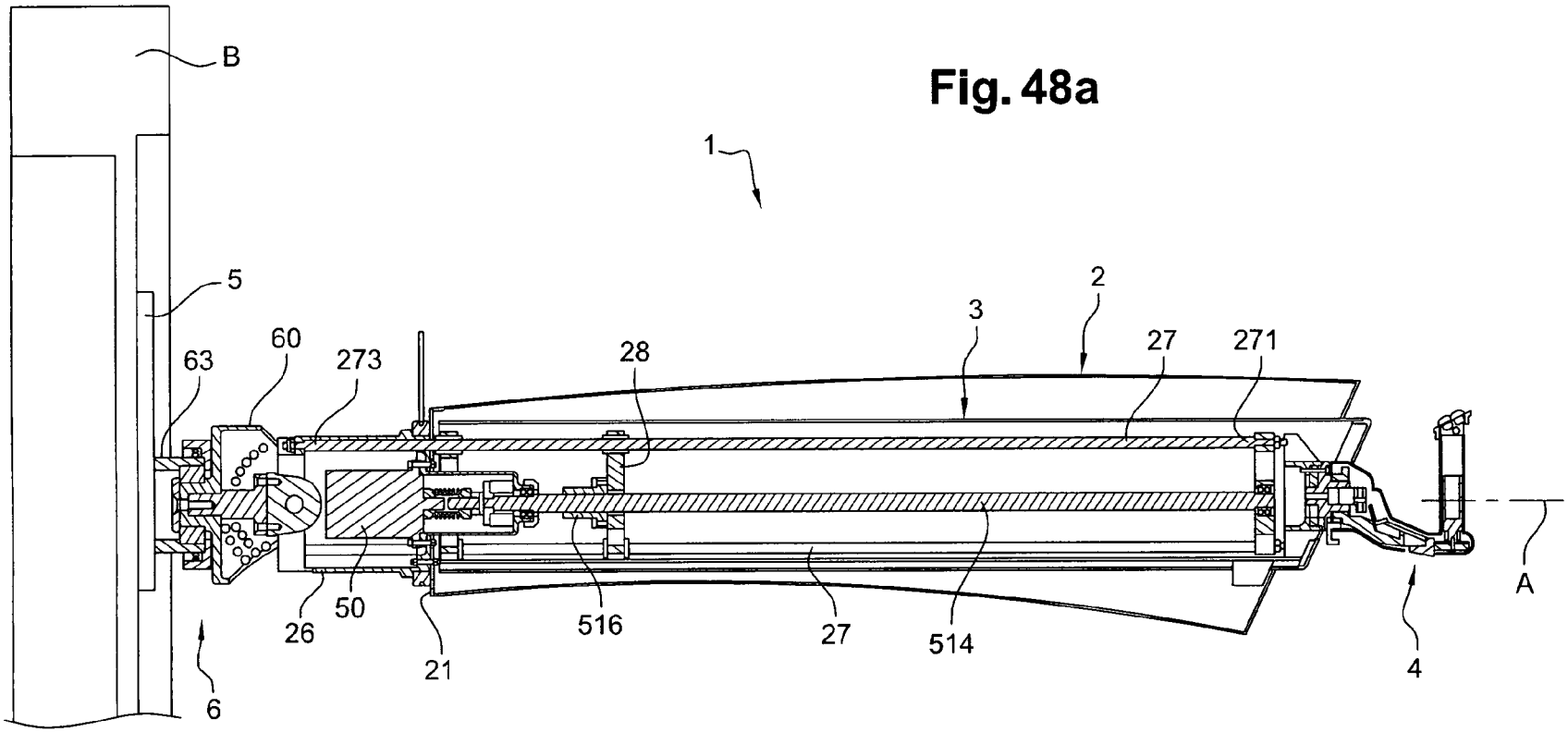
FIG. 48*a* is a schematic vertical longitudinal sectional view of the device illustrated in FIGS. 46*a* and 46*b;*
Figure 49A:
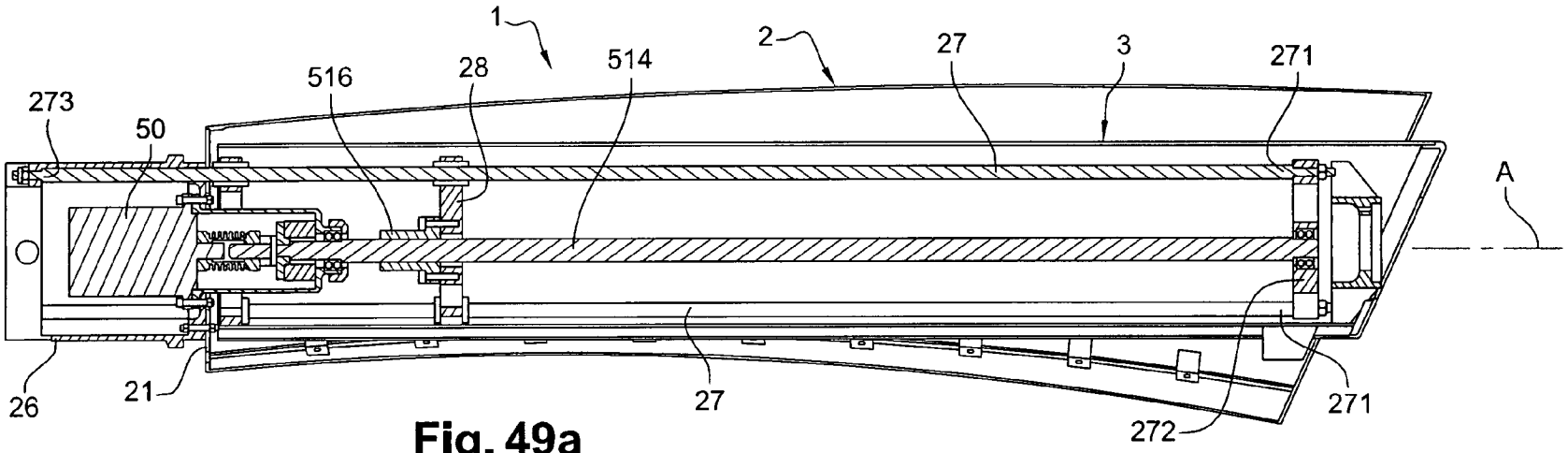
FIGS. 49*a* and 49*b* are schematic longitudinal sectional views, respectively vertical and horizontal, of the apparatus illustrated in FIGS. 46*a* and 46*b*, together with the cooperating means thereof.
Figure 49B:
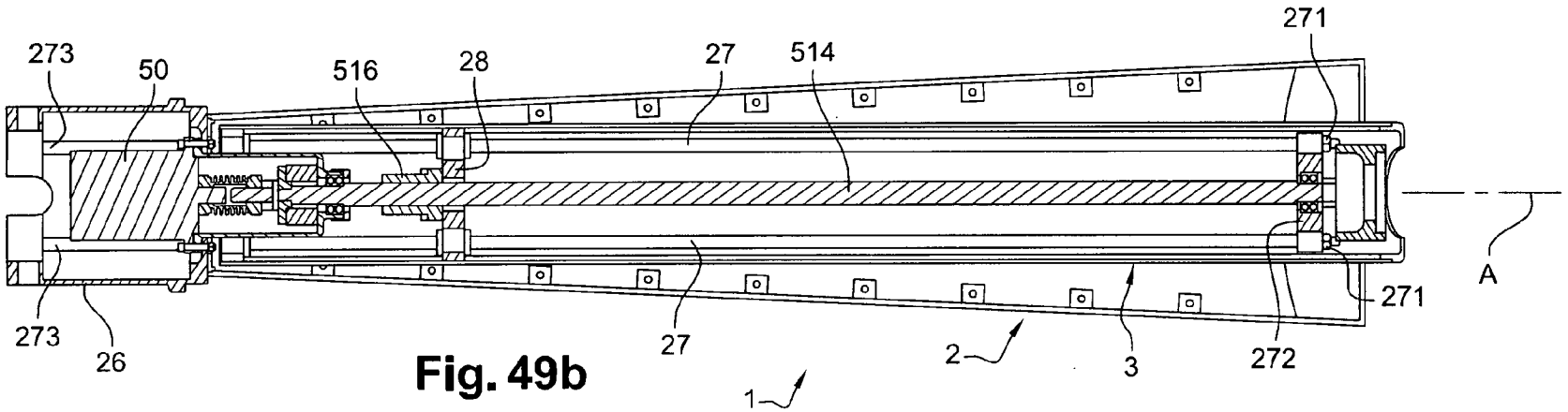

As illustrated in FIGS. 48, 49*a* and 49*b*, so as to sustain the radial efforts perpendicular to the main axis A and guide the arm 3 in the translatory movement thereof, on the inside, the body 2 is carrying guiding means for the arm 3 comprising:

- three tie bars 27 extending inside the body 2 in parallel to the main axis A and distributed at 120° from each other around the main axis A; and
- a slide 28 slidingly mounted on each of the three tie bars 27 and fixedly mounted to the arm 3 namely by means of screws 280 to be seen in FIG. 49*b*, where the slide 28 is fastened to the nut part 516 by screwing.

The slide 28 appears as a disk equipped with three through orifices of the respective tie bars 27, so that the translation of the nut part 516, and thereby of the slide 28 integral with this nut part 516, is guided by the tie bars 27.

The arm 3 is hollow and the tie bars 27 extend inside the arm 3 and go through the bottom 21 of the body 2. The tie bars 27 respectively comprise:

- a front end 271 fastened by screwing to a bearing part 272 for the threaded shaft 514; and
- a back end 273 fastened by screwing to the case 26 of the motor 50.

As illustrated in FIGS. 48, 51, 52*a* and 52*b*, the cooperating means 6 comprises a hinge 60 made as a double pivot link having two degrees of rotational freedom. This hinge 60 is mounted on the bottom 21 of the body 2, and more specifically on the case 26 of the motor 50 after the motor 50.

Figure 50:
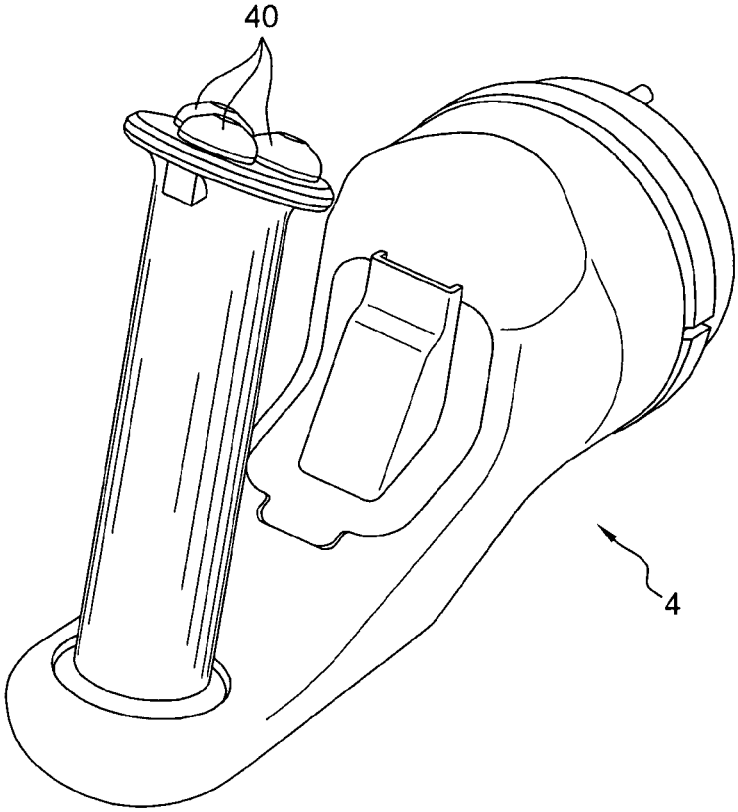
FIG. 50 is a schematic perspective view of the handle forming a connecting means of the apparatus illustrated in FIGS. 46*a* and 46*b;*
Figure 51:
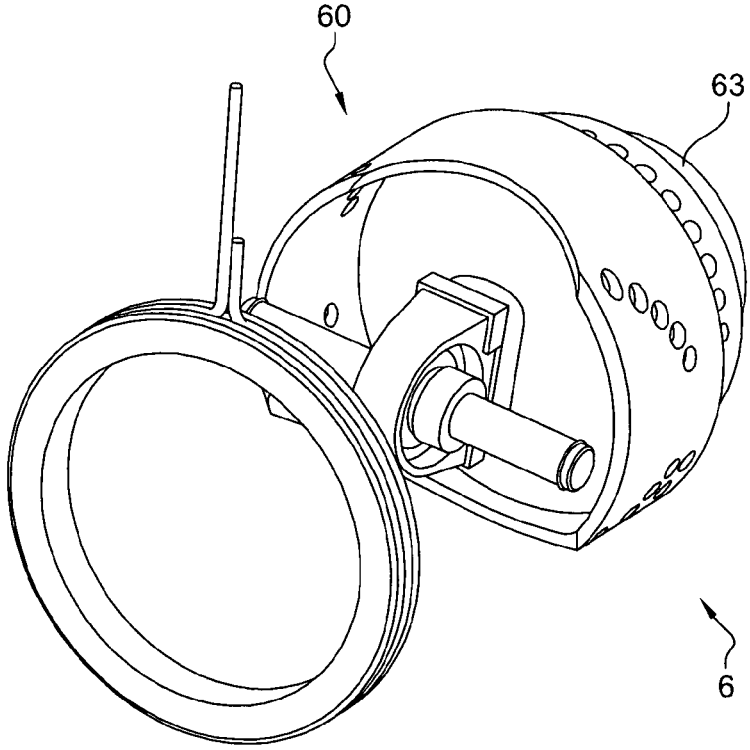
FIG. 51 is a schematic perspective view of the cooperating means of the apparatus illustrated in FIGS. 46*a* and 46*b;*
Figure 52A:
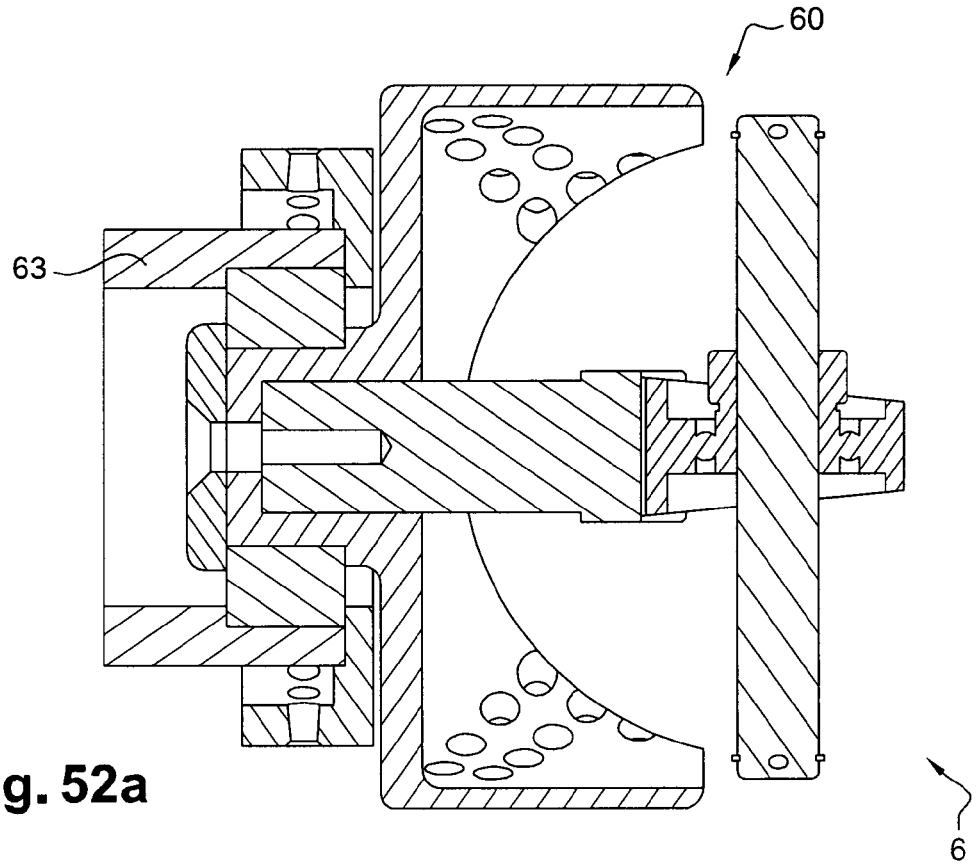
FIGS. 52*a* and 52*b* are schematic longitudinal sectional views, respectively horizontal and vertical, of the cooperating means illustrated in FIG. 51.
Figure 52B:
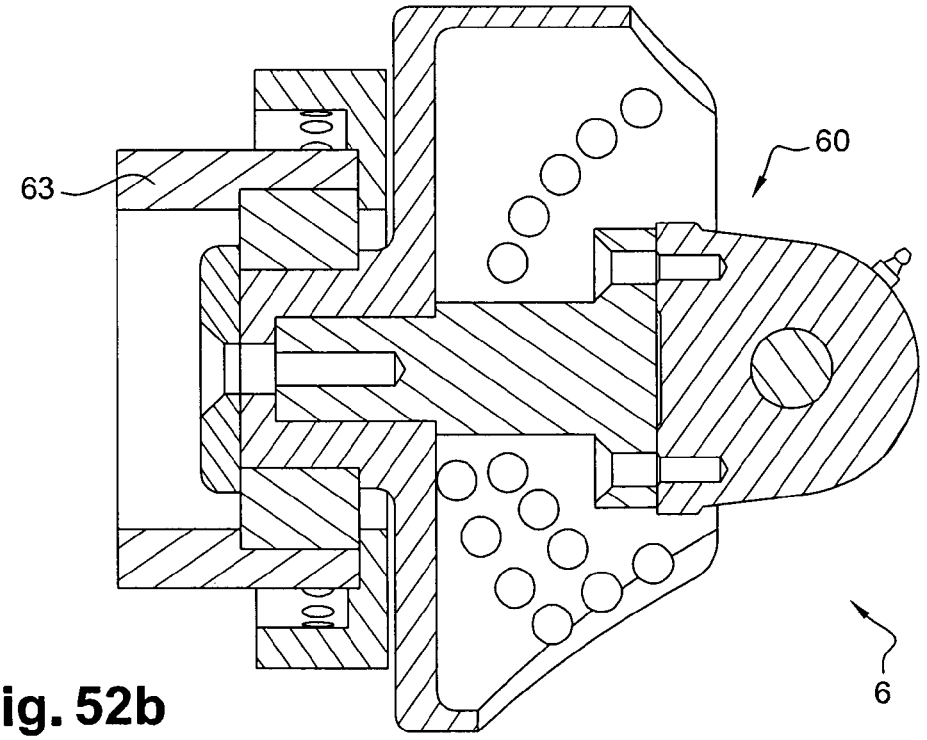

As illustrated in FIGS. 48 and 50, the connecting means 4 is made as a handle possibly equipped with control switches 40 of various functionalities of the apparatus.

FIGS. 12 and 13 schematically illustrate another type of apparatus 1 in accordance with the invention. In this other implementation, the cooperating means 6 comprising a hinge 60 is completed by or replaced with another cooperating means 7 comprising two secondary motor-driven means 70 adapted for rotationally driving the body 2 around respectively two axes of rotation B1, B2 perpendicular to each other, the two axes of rotation B1, B2 being perpendicular to the main axis A of the body 2. Of course, it can be envisaged to have a third secondary motor-driven means adapted for rotationally driving the body 1 around an axis of rotation parallel to the main axis A (or another predefined axis), or even to have only one of the secondary motor-driven means 70.

Each secondary motor-driven means 70 is fastened to the body 2, for example outside the body 2 of the apparatus 1, as schematically illustrated in FIG. 13.

Each secondary motor-driven means 70 is adapted for rotationally driving the body 2 in both directions of rotation, and also for decelerating the rotation of the body 2 in both directions of rotation. Advantageously, the or each secondary motor-driven means 70 comprises a reversible rotary motor provided for four-quadrant operation.

Each secondary motor-driven means 70 comprises an angle sensor to determine the angle of rotation of the body 2 around the associated axis of rotation B1, B2, thereby enabling the angular position of the body 2 to be determined with respect to this axis of rotation.

Each secondary motor-driven means 70 is thus designed to ensure radial movement transmission, and the motor's rotational power is calculated depending on the lever action of the body 2 and arm 3 assembly.

Figure 14:
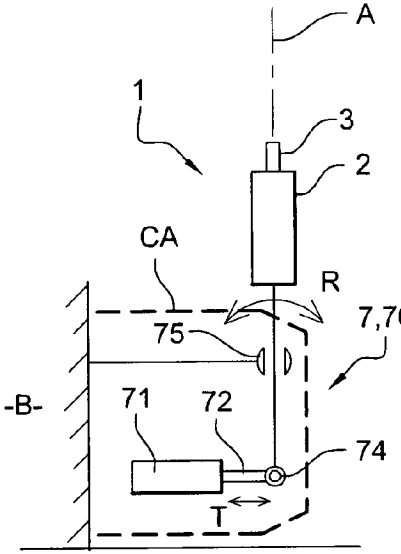
FIGS. 14 and 15 are schematic views of an apparatus in accordance with the invention equipped with secondary motor-driven means according to respectively a first and a second embodiment.
Figure 15:
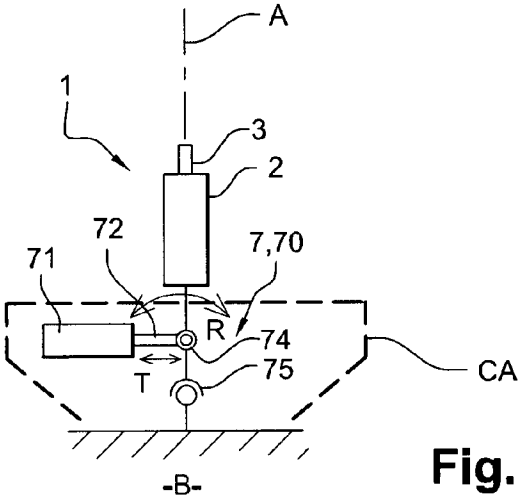

FIGS. 14 and 15 illustrate an apparatus 1 equipped with a secondary motor-driven means 70 according to distinct embodiments. In both embodiments, the secondary motor-driven means 70 is of the tow bar system type and comprises:

- a motor 71 translationally driving a control shaft 72, the translation of the control shaft 72 being illustrated by the arrows T in the figures;
- a pivoting part 73 fastened, namely in a removable way, to the body 2, said pivoting part 73 extending along the main axis A;
- a hinge 74, namely of the pivot link type, between the control shaft 72 and the pivoting part 73;
- a base 75 of the pivoting part 73 on a frame B, where said pivoting part 73 is hinged at the base 75 so as to be able to pivot around an axis inclined with respect to the main axis A.

In the embodiment of FIG. 14, the base 75 is arranged above the hinge 74, in other words between the body 2 and the hinge 74; while in the embodiment of FIG. 15, the base 75 is arranged below the hinge 74, in other words the hinge 74 is arranged between the body 2 and the base 75.

During operation, the motor 71 displaces the control shaft 72 in translation T so that this control shaft 72 pivots the pivoting part 73, and thereby the body 2, around the base 75, as schematically indicated by arrow R.

The assembly of the secondary motor-driven means 70 can be arranged inside a casing CA, illustrated by dashed lines in FIGS. 14 and 15, from which the free end of the pivoting part 73 is protruding, to which the body 2 of the apparatus 1 will be connected.

In an alternative not shown, the secondary motor-driven means 70 comprises a rotary motor/speed reducer assembly in direct engagement on the body 2.

It can also be envisaged to provide a secondary motor-driven means translationally driving the body 2 along an axis inclined (e.g. at right angles) with respect to the main axis A. Such a secondary translation motor-driven means could be coupled with a secondary motor-driven means as described above, i.e. rotatingly driving the body 2.

This or these secondary motor-driven means 70 thereby allow(s) for forcing the body part of the user to follow a delimited path T in space. Such a constraint around a path T will be described at the end of the second part with reference to FIGS. 34 to 37.

The second part regarding the control method in accordance with the invention is given below.

The invention also relates to a method for controlling the apparatus 1 described above. This control method comprises the following steps:

a) recording or inputting at least one set-point curve $C_C$ corresponding to a predefined variation of a main exercise parameter $P_P$ predetermined depending on a status parameter $P_E$ such as time or displacement of the arm 3, said main exercise parameter representing the effort of displacement imposed by the arm 3 on the user's body part or vice versa, and namely selected from the force produced by the user on the arm 3 for displacing or decelerating the arm 3, the torque or force produced by the motor-driven means 5 for displacing or decelerating the arm 3, the speed of displacement of the arm 3 and the acceleration of the displacement of the arm 3;

b) acquiring an actual curve $C_R$ corresponding to the variation of the main exercise parameter $P_P$ measured during the exercise depending on the status parameter $P_E$;

c) controlling the motor-driven means 5 so as to regulate the actual curve $C_R$ around the set-point curve $C_C$ during the exercise, said motor-driven means 5 being controlled for displacing and/or decelerating the arm 3 in a translatory movement, as described above in the first part of the description.

In order to implement the various steps of the method in accordance with the invention, the apparatus 1 is provided with means for implementing the method, such means comprising a control means 80 made as a control unit or central processing unit (to be seen in FIGS. 24 to 30, and 31).

For carrying out the recording or inputting step a) the apparatus 1 comprises:

- a storage means 81 (of the digital data memory type) adapted for recording set-point curves;
- a transfer means 82 designed for transferring set-point curves recorded at a terminal or an external storage means 92 (such as a USB stick, a computer terminal, a digital data recording disk, etc.) for the storage means 81 of the apparatus 1; and possibly
- a means for input of set-point curves by the user and/or a third party, like for example an input interface of the type of a keyboard, a screen, or the like.

The transfer means 82 can be of the type:

- a wire link, e.g. of the type of a cable link or a receiving connector of an external storage means, such as a USB connector or equivalent; or
- a wireless link, e.g. a Wi-Fi©, BlueTooth© or equivalent link.

Furthermore, the set-point curves can advantageously be downloaded from the internet or from an electronic message sent by a therapist or sports trainer, then transferred from the computer terminal of the user onto the storage means 81 of the apparatus 1.

For carrying out this acquisition step b) the apparatus 1 comprises:

- at least one first means for measuring, during the exercise, the actual main exercise parameter $P_P$, as for example an effort sensor 83 measuring the effort produced on the arm 3 or a speed sensor 84 measuring the displacement speed of the arm 3;
- at least one second means for measuring, during the exercise, the actual status parameter $P_E$, such as an internal clock of the central processing unit or a displacement sensor 85 measuring the displacement D of the arm 3.

These measuring means 83, 84, 85 are of course connected to the central processing unit 80 for carrying out step b). Also, the input means and/or storage means 81 are connected to the central processing unit 80; the central processing unit 80 being also connected to the motor-driven means 5 (as can be seen in FIGS. 24 to 27) so as to carry out step c) comprising controlling the motor-driven means 5 with regulation around the set-point curve saved in the storage means 81.

Figure 30:
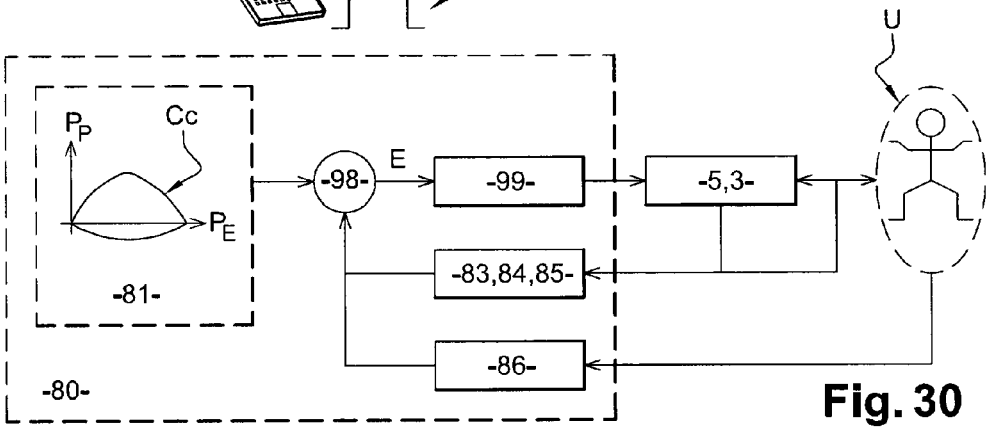
Figure 31:
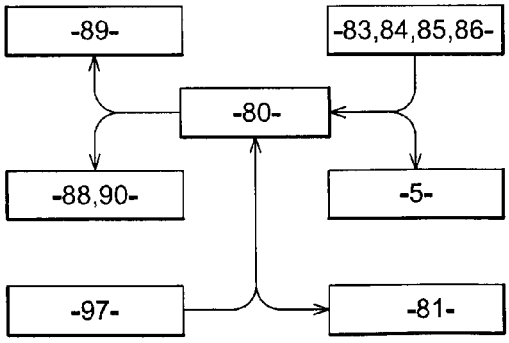
FIG. 31 represents a flow chart of the control member of an apparatus in accordance with the invention and different means in connection with this control member.

For carrying out the control or regulation step c) the apparatus 1 may comprise, as illustrated schematically in FIG. 30:

- a comparator 98 comparing the set-point curve $C_C$ saved in the storage means 81 with the data from the sensors 83 to 84, the output signal E of the comparator corresponding to the difference or the error to compensate so as to carry out the regulation; and
- a corrector or regulator 99 controlling the motor-driven means 5 to compensate for the error E.

The set-point curves $C_C$ correspond to curves programmed depending on the therapeutic, physiological, or physical objectives desired for the user or the therapist or the sports trainer. The apparatus 1 is thus multifunctional and upgradable depending on the requirements of the therapist, the sports trainer or the user, by influencing the set-point curve(s) $C_C$.

FIGS. 17 to 23 illustrate various set-point curves $C_C$1 to $C_C$7 likely to be recorded for an exercise on the apparatus 1 in accordance with the invention.

FIGS. 17 to 21 illustrate effort set-point curves $C_C$1 to $C_C$5, i.e. curves of the variation of an effort F as a function of the displacement D of the arm 3, in other words depending on the position of the arm 3 in relation to the body 2. In this case, the main exercise parameter $P_P$ corresponds to the force F (which may be the force directly applied by the user on the arm 3, or the force produced by the motor-driven means 50 for displacing or decelerating the arm 3) and the status parameter $P_E$ is the displacement D (where the time t can also be envisaged for such an effort curve).

The various set-point curves define a variation of an exercise principle $P_P$ (e.g. effort F) as a function of the displacement D of the arm 3 within a predefined range of displacement. This range of displacement is delimited by a predetermined minimum value Dmin and maximum value Dmax of the displacement of the arm 3.

The minimum value Dmin can be associated with the retracted position of the arm 3 and the maximum value Dmax can be associated with the deployed position of the arm 3, and in this case, the range of displacement corresponds to the maximum (or total) stroke of displacement of the arm 3. It can also be envisaged that one or each of the values Dmin and Dmax be associated with an intermediate position of the arm 3 situated between both end positions (retracted position and deployed position), so that the range of displacement of the arm 3 corresponds to a reduced stroke smaller than the maximum stroke of displacement of the arm 3. By influencing the values Dmin and Dmax, it is thus possible to limit the exercise to a selected range of displacement of the arm 3, and e.g. limit the exercise to a selected angular sector of a hinge.

The set-point curves $C_C$1 to $C_C$4 illustrated in FIGS. 17 to 20 correspond to an exercise comprising:

- having the user exercise in a single direction of displacement of the arm 3; and
- having the arm 3 return to a home position in a motorized way or let the user bring back the arm 3 to the home position with the motor-driven means 5 which provides a zero or almost zero resisting effort (e.g. less than 1 Newton).

These set-point curves $C_C$1 to $C_C$4 represent half a displacement cycle of the arm 3, e.g. a displacement of the arm 3 from the retracted position to the deployed position, or else a displacement of the arm 3 from the deployed position to the retracted position; a complete cycle corresponding to a reciprocating displacement of the arm 3.

Figure 17:
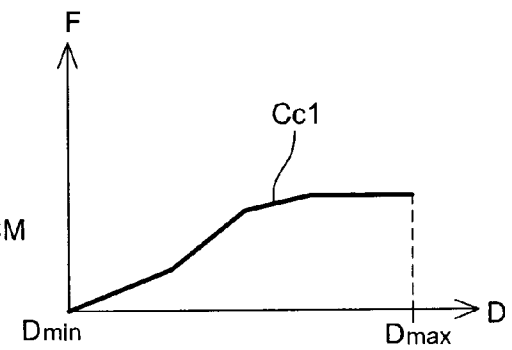
FIGS. 17 and 18 respectively represent a first $C_C$1 and a second $C_C$2 effort set-point curve for an apparatus in accordance with the invention.

In FIG. 17, the set-point curve $C_C$1 corresponds to an increase of the effort F with the displacement D of the arm 3, e.g. as the arm 3 is leaving the body 2.

Figure 18:
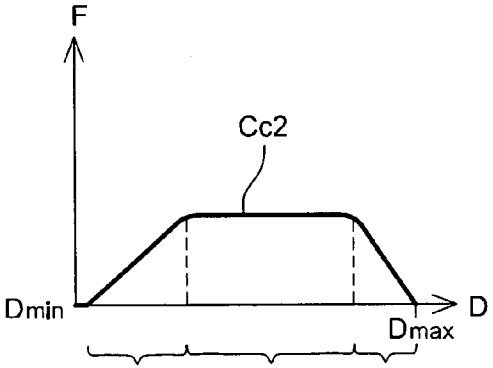
Figure 19:
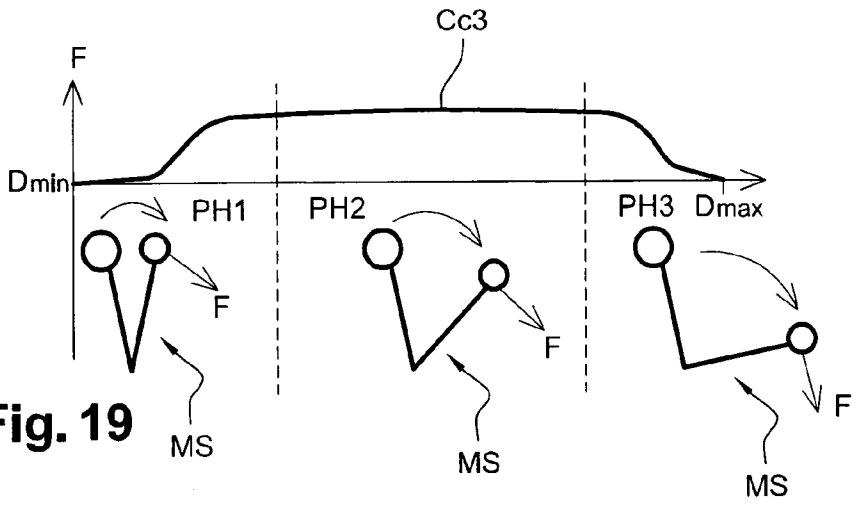
FIG. 19 represents both a third effort set-point curve $C_C$3 with three distinct phases, and the movements of an upper limb associated with each phase of the curve $C_C$3.

In FIGS. 18 and 19, the set-point curves $C_C$2 and $C_C$3 correspond to an increase of the effort F at the beginning of the displacement up to a certain plateau, followed by a decrease of the effort F at the end of the displacement. These set-point curves $C_C$2 and $C_C$3 have many advantages with respect to a curve similar to the curve C0 described above with reference to FIG. 1, namely by ensuring a progressive workout which does not generate any trauma for the user. Indeed, these set-point curves $C_C$2 and $C_C$3 correspond to an exercise comprising three distinct phases:

- a first phase PH1 with a progressive and smooth increase of the effort F, without any discontinuity at the beginning of the displacement (D=0, home position);
- a second so-called plateau phase PH2 with a constant or almost constant effort F; and finally
- a third phase PH3 with a progressive and smooth decrease of the effort F, without any discontinuity until the end of the displacement.

FIG. 19 also illustrates the movement of an upper limb MS (or arm) during the three phases of this exercise, with arrows F illustrating the effort F undergone by the upper limb MS during displacement of the mobile arm 3 of the apparatus 1.

Figure 20:
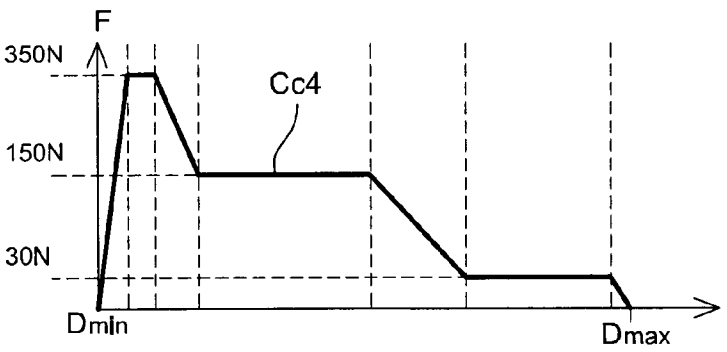
FIG. 20 represents a fourth effort set-point curve $C_C$4.

In FIG. 20, the set-point curve $C_C$4 corresponds to a linear increase of the effort F at the beginning of the displacement up to a first plateau (e.g., situated at the value of 350 N), followed by a linear decrease of the effort F up to a second plateau (e.g., situated at the value of 150 N), also followed by a linear decrease of the effort F up to a third plateau (e.g., situated at the value of 30 N), and finishing with a last linear change of the effort F up to the x-axis at the value of 0 N.

This set-point curve $C_C$4 is namely interesting for exercising the user's body part with decreasing effort plateaus.

Figure 21:
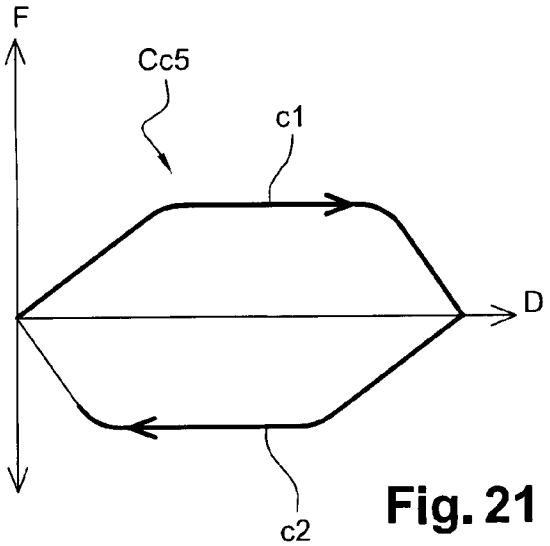
FIG. 21 represents a fifth effort set-point curve $C_C$5 for a reciprocating displacement cycle of the mobile member.

The set-point curve $C_C$5 illustrated in FIG. 21 corresponds to an exercise comprising:

- having the user exercise according to a first direction of displacement of the arm 3, with a regulation around the first part C1 of the set-point curve $C_C$5; and
- having the user exercise according to a second direction of displacement of the arm 3 opposed to the first direction, with a regulation around the second part C2 of the set-point curve $C_C$5.

Thereby, this set-point curve $C_C$5 represents a complete displacement cycle of the arm 3; the first half-cycle corresponding to the first part of curve C1 and the second half-cycle corresponding to the second part of curve C2. Indeed, the apparatus 1 allows for exercising in both translatory directions of the arm 3, i.e. producing an effort or resistance to an effort of compression and traction as described above in the first part of the description.

In FIG. 21, the first part of curve C1 is of the same type as the set-point curve $C_C$2 described above with reference to FIG. 18, and the second part of curve C2 is also of the same type as this set-point curve $C_C$2, with the same advantages as described above in both translatory directions of the arm 3.

The two parts of curve C1 and C2 which correspond to an effort of traction and compression (or thrust), are totally independent from each other; wherein each curve part can be parameterized distinctly and independently from the other curve part, depending on the pathology to be treated and/or the training adapted to the user. For example, the parameters representing the curve parts C1 and C2 illustrated in FIG. 21, such as the progression of the effort in the first and third phases and the absolute value of the plateau in the second phase, can be distinct for the two curve parts C1 and C2.

Figure 22:
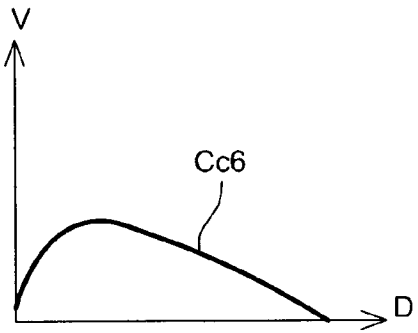
FIGS. 22 and 23 respectively represent a sixth $C_C$6 and a seventh $C_C$7 speed set-point curve for an apparatus in accordance with the invention.
Figure 23:
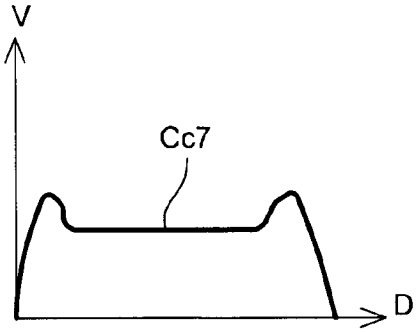

FIGS. 22 and 23 illustrate the speed set-point curves $C_C$6 and $C_C$7, i.e. curves of the variation of the displacement speed V of the arm 3 as a function of the displacement D of the arm 3 (or possibly of time). These set-point curves $C_C$6 and $C_C$7 are illustrated only for half a displacement cycle of the arm 3.

In FIG. 22, the set-point curve $C_C$6 corresponds to an increase in speed V at the beginning of the displacement followed by a decrease in speed V.

In FIG. 23, the set-point curve $C_C$6 corresponds to an increase in speed V up to a speed plateau, followed by a return to zero at the end of the displacement. Thus, at the plateau, the user is doing an isokinetic exercise, i.e. at constant speed.

In use, the parameters of the set-point curve $C_C$ are easy to program by the user, the therapist or the sports trainer depending on the needs for reeducation or training. Thereby, the user who will carry out the exercise will be able to do so without restraint.

The choice of the set-point curve $C_C$ may involve the wish to do aerobics. In this case, an effort set-point curve will allow for providing areas of recovery within the very exercise (as the third phase PH3 of the curves $C_C$2 and $C_C$3 described above) and the pace of the effort will be tuned so as not to unbalance the respiration rate for proper oxygenation of the muscles and to avoid toxin production; toxins essentially result from exercising the muscle without oxygen, i.e. in anaerobia. Moreover, it is possible to program the set-point curve so that the respiration and heart rates are no longer modeled on the whole effort phase.

The choice of the set-point curve $C_C$ may also involve the wish to avoid strong efforts: by programming the effort, strong efforts will be eliminated, instead there will be a progressive increase up to a pre-adjusted maximum effort, as for curves $C_C$2 and $C_C$3 described above. Thereby, jerks are removed and the effort is progressive, implying reduced strain on tendons, joints, and the heart, thus making the exercises accessible for people with cardiovascular predispositions.

The choice of the set-point curve $C_C$ may also involve the wish to exercise a desired muscle chain: the effort is targeted for one or several selected muscle chains, while the others which are not strained are resting. Therefore, the exercise appears to be more smooth and pleasant for the user. Thereby, it is possible to exercise a single kinetic chain. Programming may target the effort on a precise range of displacement of the muscle so as to exercise only certain muscle fibers and strain the others minimally, for example in case the user has muscle issues.

Moreover, the advantage of being able to program the set-point curves $C_C$ is the possibility of removing the effort involved in accompanying the return so as to exercise only a single group of muscles without straining the antagonist chains, as in the case of curves $C_C$2 and $C_C$3, or to the contrary to include an effort upon return, as in the case of curve $C_C$5. The second part of curve C2 (effort upon return) is programmed to be continuous with the first part of curve C1 (effort upon forward movement) so as not to inflict jerks when the direction of displacement is inverted.

As in the case of curve $C_C$5, the apparatus 1 advantageously allows for a tractive effort to be associated with a thrust effort. This means that the apparatus 1 may exercise two clearly distinct muscle chains in the same movement, while eliminating effort discontinuities damageable for joints, tendons, heart, etc. and thus make the session much more pleasant. Such programming furthermore allows for 50% time savings on the exercise time by exercising two distinct muscle chains in the same movement.

The method in accordance with the invention further comprises the following measuring step d) which comprises measuring, during the exercise, at least one set-point parameter $P_C$ selected from:

- a secondary exercise parameter $P_S$ distinct from the main exercise parameter $P_P$, said secondary exercise parameter $P_S$ representing the effort of displacement imposed by the arm 3 on the body part of the user or vice versa and namely selected from the force produced by the user on the arm 3 for displacing or decelerating the arm 3, the torque or force produced by the motor-driven means 5 for displacing or decelerating the arm 3, the speed of displacement of the arm 3, and the acceleration of the displacement of the arm 3; and/or
- a physiological parameter $P_{PHY}$ representing the physiological state of the subject and namely selected from electromyographic activity, respiration rate, heart rhythm, temperature of the user, blood oxygen level, blood pressure, and perspiration; and/or
- a duration parameter $P_D$ representing the duration of the exercise and namely selected from the duration of the exercise, the number of displacement cycles carried out by the arm 3, the time required for the user to carry out one or several predetermined displacements of the arm 3; and/or
- an environmental parameter $P_E$ representing the external environment in which the user is carrying out the exercise, and namely selected from external ambient temperature, external level of humidity, external ambient pressure.

For carrying out this measuring step d) the apparatus 1 comprises at least one third means for measuring the set-point parameter $P_C$, such as for example:

- a sensor for the secondary exercise parameter $P_S$ which may be the effort sensor 83 or the speed sensor 84;
- a physiological sensor 86 (illustrated in FIGS. 29 to 31) as for example a temperature probe, a probe for measuring electromyographic activity, respiration rate or heart rhythm, etc.;
- an environmental sensor 87, such as for example a hygrometer, a temperature probe, a pressure gage, etc.

Of course, such third measuring means are connected to the central processing unit 80 for performing the measuring step d).

The method in accordance with the invention also comprises the following two steps:

e) during the exercise, comparing the at least one set-point parameter $P_C$ with at least one predefined threshold value, namely of the type of a minimum threshold value or maximum threshold value, wherein said comparison can namely be carried out over a predetermined period of time and/or a predetermined portion of the displacement D of the arm 3; and f) modifying or replacing the set-point curve $C_C$ if in step e) at least one set-point parameter $P_C$ is greater or smaller than the corresponding threshold value, before of resuming steps b) to e) described above with the set-point curve $C_C$ as modified or replaced so as to adapt the exercise to the user according to a predefined exercise protocol depending on the progress of the set-point parameter $P_C$.

The principle of these two steps e) and f) comprises modifying the course of the exercise depending on the progress of the selected set-point parameter $P_C$, or depending on the progress of several selected set-point parameters $P_C$. Modifying the course of the exercise is to be understood as carrying out either of the following functions:

- modifying the set-point curve $C_C$ used as a basis for regulation of step c), the modification of the set-point curve $C_C$ comprising modifying the parameters defining this curve, as for example the slope of the curve at certain points (beginning and/or end of displacement of the arm 3), the y-value of the plateau(s), the x-value of the end points of the plateau(s), etc.;
- replacing the set-point curve $C_C$ with another set-point curve, such as for instance replacing curve $C_C$1 with curve $C_C$2.

These two functions are substantially equivalent because replacing curve $C_C$1 with curve $C_C$2 is like modifying curve $C_C$1 so that it becomes curve $C_C$2; and vice versa modifying curve $C_C$ is like replacing the same with another different curve.

Finally, the exercise has to be modified so as to adapt it to the user. For example, if the user has difficulties in following an effort set-point curve $C_C$ and the speed V of displacement of the arm 3 drops below a threshold value predefined by the therapist, the set-point curve is modified or replaced so that it is less difficult for the user to carry out the exercise.

Different set-point parameters $P_C$ can be taken into account before and during the execution of the program in accordance with the invention. Such set-point parameters $P_C$ can be of two types:

- on the one hand, internal parameters of the apparatus (namely speed V, acceleration, displacement D or positioning, effort F etc.); and
- on the other hand, external parameters related to the central processing unit 80 which will provide the latter with information on the environment (environmental parameter $P_E$) and above all on the user (physiological parameter $P_{PHY}$). The regulation of the motor-driven means 5 takes into consideration one or several of these various set-point parameters $P_C$.

E.g. it can be envisaged to have a set-point curve $C_C$ of the effort F as a function of the displacement D of the arm 3, the selected set-point parameter $P_C$ being the speed V of displacement of the arm 3; the speed being a resultant from the effort F and the displacement D. Such programming will allow for simulation of a common exercise at the physiotherapist's in conventional reeducation, i.e. the user has to produce an effort to which progressive resistance is opposed by the therapist.

E.g. it can be envisaged to have a set-point curve $C_C$ of the speed V of displacement of the arm 3 as a function of the displacement D of the arm 3, the selected set-point parameter $P_C$ being the effort F. Such programming allows for carrying out isokinetic exercises, i.e. at constant speed. Isokinetic exercises will generally lead to exercises where the user carries out an exocentric exercise, i.e. producing the resisting counter-effort to a controlled speed thrust or traction performed by arm 3. Thereby, the user will be in deceleration mode and the motor-driven means in drive mode. The decelerating exocentric exercise is generally used during the first reeducation sessions, and it is mainly used for fitness exercises for elderly subjects; which is why the apparatus in accordance with the invention is of interest.

The physiological sensor(s) 86, which will namely monitor the user's heart beat rate and blood pressure, is/are mainly used for adding safety monitoring for high-risk or weak persons.

The physiological parameter(s) $P_{PHY}$ collected during the exercise is/are thus used in real time for adapting the exercise to the user, i.e. this data can, according to pre-established programs (definition of threshold values and of a predetermined period of time and/or predetermined portion of the displacement D of the arm 3), change the reeducation or training program in real time.

Furthermore, this physiological data can also be restored in real time to the user, and possibly a therapist or sports trainer, or even be recorded for later restoring to these persons. The data can then be used for bringing adaptations into the programs of successive exercises within the same session or for the following sessions. Therefore, the apparatus 1 is of the adaptive type, because it may adapt to the physical and pathological characteristics of the user before the session and provide programs, or else, the exercise could be dependent in real time on the subject's attitude and provide proposals for progress of the initial protocols.

It is possible for the method to also include a step of receiving at least one instruction issued by the user or a third party, such as a therapist or sports trainer, and a step of modifying or changing of the set-point curve $C_C$ depending on said order. In order to perform this step, the apparatus 1 comprises a means 97 for receiving an order connected to the central processing unit 80 and adapted for performing the receiving step described above, the central processing unit 80 being of course adapted for performing the step of modifying or changing the set-point curve $C_C$ depending on said order.

Thus, it is possible to modify the current exercise along the way as ordered by the user, therapist or sports trainer; the modification of the exercise corresponding to the same type of modification as described below for step f) of the method. For example, the user may wish to make the exercise more difficult, by increasing the effort, if he/she feels fit. Furthermore, the user may adapt the exercise deliberately within a unitary movement, namely so as to accelerate, increase force, add iterations or time, or extend a displacement and have the modification taken into account in real time.

It is also advantageous for the method to comprise a step of displaying the progress of the main exercise parameter $P_P$ and/or at least one set-point parameter $P_C$ during the exercise in order to inform the user and/or a third party of the progress of this or these characteristic parameter(s) of the exercise carried out by the user. In order to perform this step, the apparatus 1 comprises a display means 88 connected to the central processing unit so as to display the progress of the parameter(s) $P_P$ and/or $P_C$ during the exercise.

The display means 88 can be made as a screen or monitor or a LED array arranged on the body 2 of the apparatus 1 or outside the body 2.

The point is to show in real time how the user is doing with the programmed exercise, so that the user can modifier his/her behavior in real time or so that a therapist or sports trainer can send a set-point to the central processing unit 80 to modify the exercise in real time; the objective again being to adapt the exercise to the user.

It is also advantageous for the method to include a step of transmitting data conveying the progress of the main exercise parameter Pp and/or at least one set-point parameter $P_C$ during the exercise for an external terminal, namely of the type of a telephone and/or computer terminal, in order to inform a third party situated at a distance from the user of the progress of this or these parameter(s). In order to perform this step, the apparatus 1 comprises a transmission means 89 connected to the central processing unit 80 and adapted for performing this transmission step. The transmission means 89 can be of the wire transmission or wireless transmission type.

The point being to enable to a remote person to follow the exercise of the user, for example via a computer network (internet, intranet, or equivalent); wherein this person, depending on the progress of the transmitted parameter(s), may then send a set-point to the central processing unit 80 so as to modify the exercise in real time. Moreover, the data transmitted can be stored (e.g. in an external computer terminal, or even in the storage means 81) for later analysis, namely so as to establish comparisons between the various exercise sessions, modify subsequent exercises, and make a diagnosis.

Figure 29:
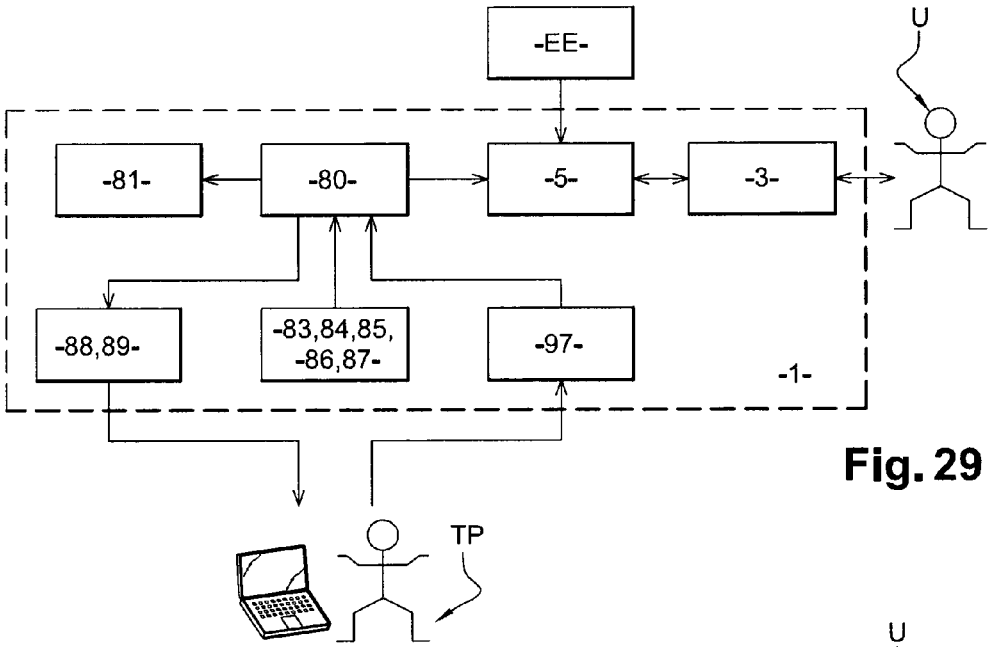

FIG. 29 illustrates the third party TP, possibly located at a distance from the user U who is carrying out the exercise, with the third party TP receiving or viewing data via the display means 88 and/or the transmission means, and with the third party TP sending an order to the central processing unit 80 via the receiving means 97. In this FIG. 29, a power source EE is also illustrated for supplying the motor-driven means 5, among others; wherein this source may e.g. be the mains or an electric battery.

Furthermore, the method may include a step of guiding the user, comprising generating a set-point signal, namely of the type of a visual, audible, or haptic signal for the user, so as to guide the user in the exercise namely in terms of:

- effort or speed to produce for displacing the arm 3 or decelerating the displacement of the arm 3;
- time or number of cycles remaining for the exercise or for the corresponding exercise phase.

In order to perform this step, the apparatus 1 comprises a means 90 for guiding the user in the exercise, said guiding means 90 being connected to the central processing unit 80 and adapted for generating the guiding signal defined above. This guiding means 90 can be made as:

- a sound signal generator, such as a sound generator (the frequency and/or strength of the sound signal being associated with a particular recommendation for the user) or a voice phrase generator issuing voice recommendations (such as for instance recommendations like "push harder", "pull less", etc.);
- a visual signal generator capable of issuing several distinct light signals, each light signal being associated with a specific recommendation for the user, such as for example a color signal generator (the color being associated with a recommendation), a flash signal generator (the frequency of the signal being associated with a recommendation), a written phrase generator (the content of the phrase being associated with a recommendation);
- a haptic signal generator, such as for example a vibration generator arranged on or in the connecting means 4, such as a vibrator in a handle 4.

With this apparatus 1, it is possible to carry out remote follow-up of the exercise, such as for instance for performing remote reeducation or sports coaching sessions. Thus, exercises may be performed at special premises (physiotherapist practice, training center, body-building gym, fitness club, etc.) or at home. The exercise programs or protocols can be remote downloadable via the internet. All of the data related to the execution and the result of an exercise is also remote downloadable via the internet. The hardware, the conversation modes and the site form an application package allowing for a personalized exercise protocol to be prepared by a professional from the data, namely the pathological, physiological, or physical data.

The data of the exercises performed in real time and transmitted via the transmission means 89, allows for real interaction between the user and the third party professional during the exercise. Coupling with an on-line camera (namely of the webcam type) enables the professional to point out to the user corrections of postures and movements. The data related to the exercise performed can then be downloaded by the professional at the end of the exercise, enabling the latter to adapt the exercise protocol between each session.

The user, sports trainer, or therapist, has the possibility of registering with an internet site and downloading the set-point curves $C_C$ and the exercise programs or protocols on-line, depending on the objectives envisaged for therapeutic reasons, for muscle build-up, physical conditioning, or weight loss. These persons may also download the user's results (progress of the actual curves) in real time or after the exercise, namely for comparison of these results with theoretical data, averages, results obtained with previous exercises, or else results of another user. It can also be envisaged that people registered with this internet site create new curves, new exercise programs or protocols and provide them for other people registered with the relevant internet site.

Figure 32:
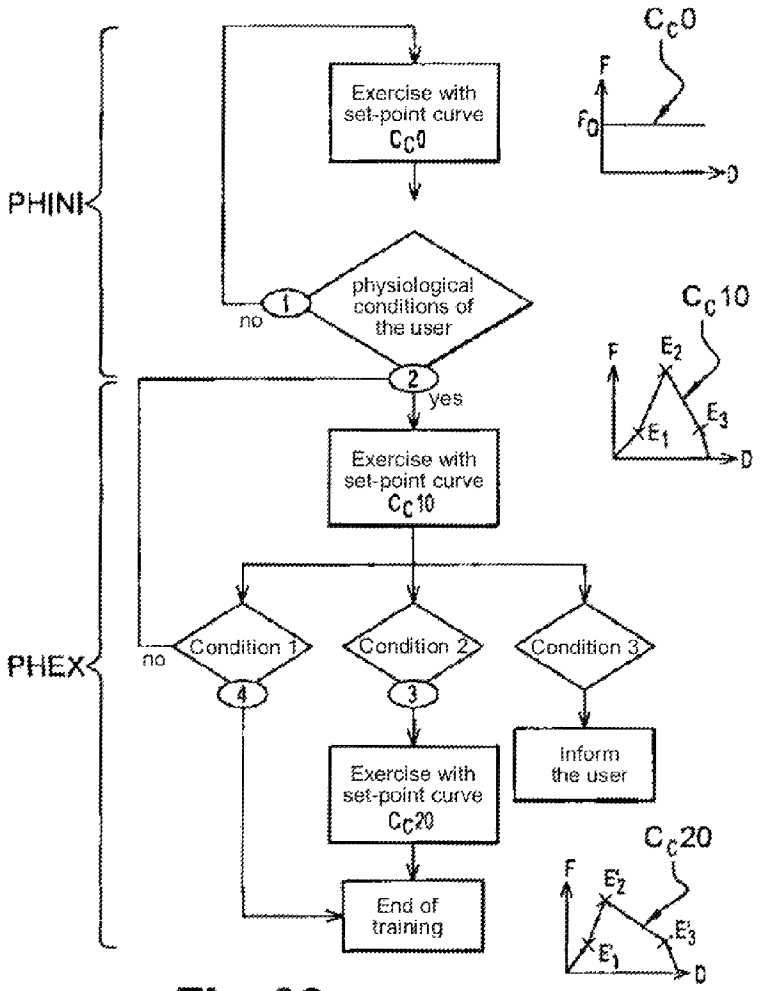
FIG. 32 illustrates an example of an exercise protocol or strategy for an apparatus in accordance with the invention.

FIG. 32 illustrates an example of an exercise protocol with a series of phases (or steps). For this protocol, two set-point curves, respectively a first one $C_C$10 and a second one $C_C$20, are recorded in the storage means 81.

The exercise protocol defines several successive exercise phases:

- a so-called initialization phase PHINI, at the beginning of exercise, in which:
  - the user carries out the exercise with a set-point curve $C_C$0, this set-point curve CC0 being namely selected for testing or warm-up of the user (as for example the illustrated effort curve $C_C$0 corresponding to a curve with a constant effort $F_0$ as a function of the displacement D); and
  - a condition regarding the physiological state is required to continue with the next phase, by comparison between a physiological parameter $P_{PHY}$ and a maximum or minimum threshold value (as for example the heart rhythm of the user which is compared to a maximum threshold value, for example a value of 120 beats per second, so that the process moves on to the next phase if the heart rate is lower than the maximum threshold value; in other words, as long as the heart rate is greater than the maximum threshold value, the user will continue the exercise at set-point curve $C_C$0 and will not move on to the next phase);
- an actual exercise phase PHEX, following the initialization phase PHINI provided the physiological condition is satisfied (e.g. the heart rate is below the maximum threshold value).

The exercise phase PHEX can comprise two successive exercise phases:

- a first phase in which the user carries out the exercise with a first set-point curve $C_C$10 (as for example the illustrated effort curve $C_C$10); followed by
- a second phase in which the user carries out the exercise with a second set-point curve $C_C$20 different from the first set-point curve $C_C$10 (as for example the illustrated effort curve $C_C$20) if condition 2 is satisfied.

Thus, the process moves from the first to the second phase provided that condition 2 is satisfied, this condition relating to a set-point parameter as described above. For example, this condition 2 may comprise comparing the speed V of displacement of the arm 3 with a minimum threshold value, for example the speed V up to the point E1 of the first illustrated set-point curve $C_C$10; the first set-point curve $C_C$10 being defined by the coordinates (force F and displacement D) of three points E1, E2, and E3. Thus, the process moves on to the second phase if the speed V is greater than the minimum threshold value; in other words, as long as the speed V is lower than the minimum threshold value the user will continue the exercise on the first set-point curve $C_C$10 and will not move on to the second phase.

When in the second phase, the user carries out for example the exercise for a number of (reciprocating) displacement cycles of the arm 3 before the end of the training.

However, during the first phase, the number of displacement cycles is also counted so that, if condition 2 is never satisfied, the user accesses the end of training when he/she has carried out a predetermined number of displacement cycles of the arm 3. This condition corresponds to condition 1 of FIG. 32 which is satisfied when the number of cycles reaches the predetermined value.

In parallel with conditions 1 and 2, it can be envisaged to carry out one or several measures on the actual curves so as to check whether the user is really capable of following the first set-point curve $C_C$10. It is considered that the user does not follow the exercise if condition 3 is satisfied, and in this case, the user is informed of this situation via the means described above. For example, this condition 3 may comprise comparing the actual effort at point E2 with a maximum threshold value. Thus, the user is informed if this effort is smaller than the maximum threshold value; in other words, as long as the effort is greater than the maximum threshold value the user will continue the exercise normally.

During training, a first series of tests takes place in real time during one cycle. Firstly, the central processing unit makes sure that the motor-driven means is true to the recorded set-point curve, and furthermore also monitors the physiological parameters which can in critical instances modify the cycle planned; a cycle corresponding to a reciprocating sequence of the arm 3, an exercise corresponding to a sequence of identical cycles, and training corresponding to a set of identical or different exercises. At the end of a cycle, the same tests are performed.

Referring to FIG. 32, depending on the results of the tests, the following may be performed:

- restarting the same cycle (path #1);
- modifying the parameters of the current cycle (path #2), corresponding to replacement or modification of the set-point curve;
- moving on to another exercise (path #3);
- ending the training (path #4).

Thus, at any time t and at each end of cycle, a set of tests is performed and the results of these tests specify the next path to follow.

Figure 33:
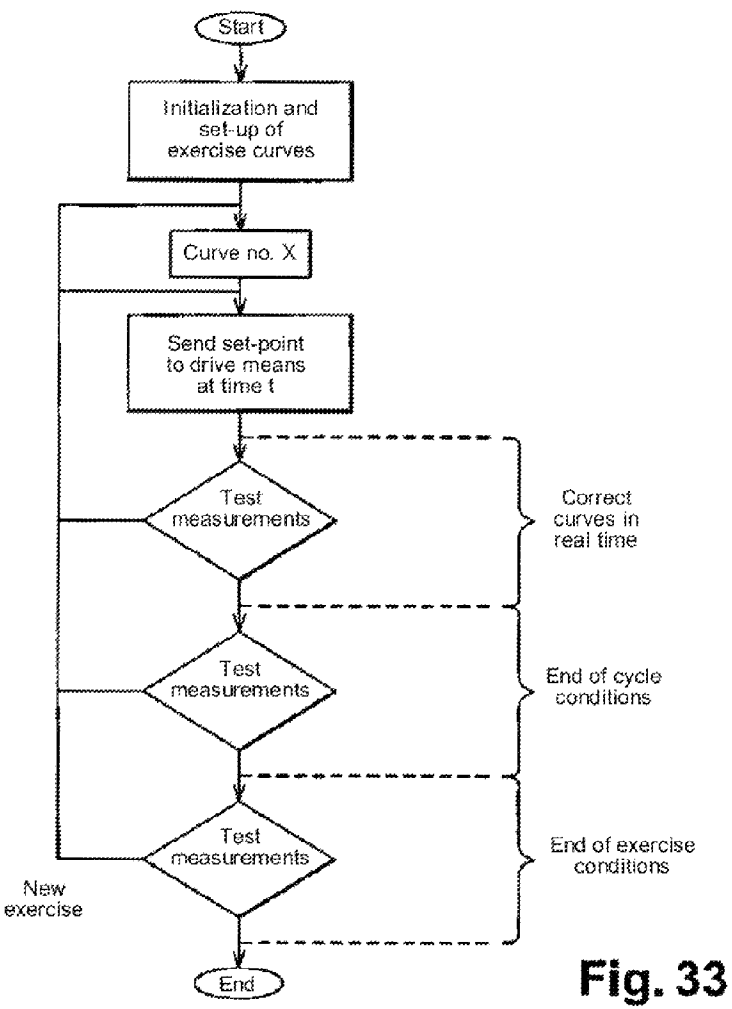
FIG. 33 illustrates a template for defining an exercise protocol or strategy for an apparatus in accordance with the invention.

FIG. 33 illustrates a general protocol template as an algorithm.

In a particularly interesting so-called "multi-axis" version, the method comprises a step of locating the arm 3 in space, and a step of steering the position of the arm 3 in space so as to oblige the user to follow, with the arm 3, a delimited path in space during the exercise.

Such an implementation can be envisaged with the apparatus 1 comprising the cooperating means 7 as described above in the second part of the description, in other words the cooperating means 7 provided with secondary motor-driven means 70 allows to oblige the user to follow a delimited path in space.

The step of locating the arm 3 in space is performed by means of the angle sensors equipping each of the secondary motor-driven means 70 and by means of the displacement sensor 85 measuring the displacement D of the arm 3; wherein the information delivered by these sensors specifies the position of the free end of the arm 3 in connection with the user, and thus the path followed by this free end of the arm 3 and thus followed by the user.

Figure 34:
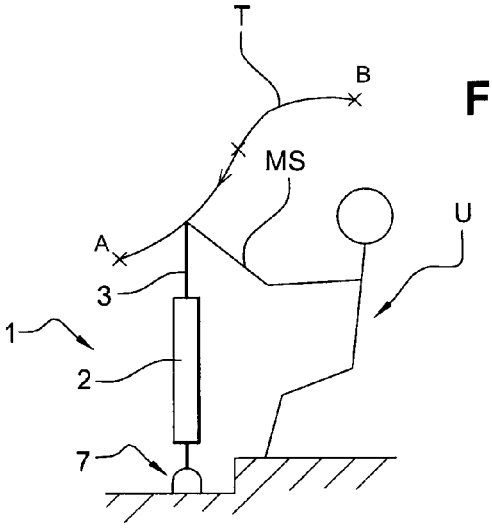
FIG. 34 schematically illustrates a user using an apparatus in accordance with the invention and trying to follow a path delimited in space.
Figure 36:
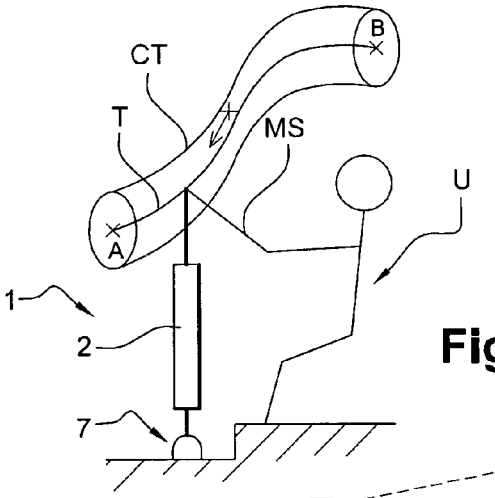
FIG. 36 schematically illustrates the user of FIG. 34 trying to stay within a tolerance area surrounding the delimited path.
Figure 37:
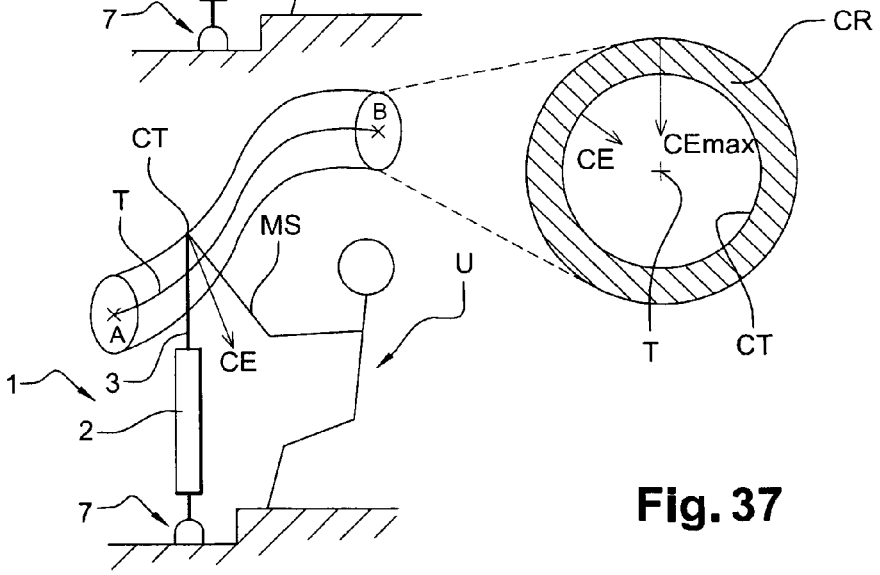
FIG. 37 schematically illustrates on the one hand the user of FIG. 34 trying to stay within the tolerance area under the effect of the motor-driven means and/or secondary motor-driven means of the apparatus, and on the other hand an enlarged section of the tolerance area.

FIGS. 34, 36, and 37 illustrate a user U performing an exercise on an apparatus 1 comprising exercising an upper limb MS (or arm) by displacing and/or decelerating the arm 3 of the apparatus 1. This apparatus 1 comprises a cooperating means 7 as described above in the second part of the description, in other words a cooperating means 7 provided with secondary motor-driven means 70 allowing to oblige the upper limb MS of the user U to follow a delimited path T in space.

In this "multi-axis" implementation, the central processing unit 80 controls the motor-driven means 5 and the secondary motor-driven means 70 so as to possibly regulate the path of the arm 3 around a predefined path T, advantageously stored in the storage means 81. For this purpose, the central processing unit 80 calculates in real time the path of the arm 3 (by means of the sensors mentioned above) and regulates the various motor-driven means 5, 70 so as to oblige the user U to follow the path T.

Figure 35:
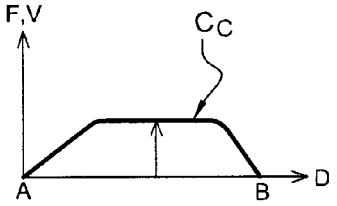
FIG. 35 illustrates a set-point curve $C_C$ associated with the exercise carried out by the user illustrated in FIG. 34.

During the exercise, the apparatus 1 continues to impose a regulation around the set-point curve $C_C$ visible in FIG. 35 and corresponding to an effort F or speed V curve depending on the displacement D of the arm 3.

As can be seen in FIG. 34, during the exercise, the user must thus follow the path T forming some kind of virtual trajectory in space, between two end points, i.e. a point A (where the arm 3 is in the deployed position) and a point B (where the arm 3 is in the retracted position); these points A and B being also illustrated in FIG. 35.

The path T depends on the selected exercise and more particularly on:

- the pathology to be treated; and/or
- the muscles or muscle chains which are desired to exercise, or to the contrary, which are not desired to exercise; and/or
- the joints which are desired to exercise, or to the contrary, which are not desired to exercise.

In the course of the displacement of the arm 3 along the path T, the effort, counter-effort, or speed will for instance be imposed by the motor-driven means 5 according to the pre-programmed set-point curve $C_C$.

As can be seen in FIG. 36, an exercise window CT is created around the predefined path T. In other words, as long as the user U exercises within this exercise window CT, he/she will be performing the exercise under the conditions defined before, in other words the apparatus 1 will apply thereto only the regulation around the set-point curve $C_C$ (as for example an effort or speed regulation during the displacement of the arm). In other words, the user will benefit from some error margin in the displacement around this path T and movements will thus take place within this central window CT on the path T between points A and B.

On the other hand, and as illustrated in FIG. 37, if the user U reaches the limits of the exercise window CT, the apparatus 1 will regulate the motor-driven means 5, 70 required for correcting the incorrect path followed by the user U by imposing a counter-effort CE more or less strong so as to oblige the user to return within in limits of the exercise window CT. In addition, the apparatus 1 may send a message to the user informing him/her that he/she is not correctly following the path, namely by using the guiding means 90 or the display means 88.

A border CR may be created around the exercise window CT, wherein the radial counter-effort CE will oblige the user U to stay within the window CT provided by the exercise as long as the user U does not penetrate into the border CR. If the user U continues to move away from the path T, so as to leave the exercise window CT and penetrate into the border CR, the counter-effort CE will increase until it reaches a predetermined maximum value CEmax at the limits of the border CR. The increase of the counter-effort CE in the border CR may be progressive or discontinuous up to the limits of the border CR.

The third part regarding use of the apparatus in accordance with the invention is given below.

FIGS. 38 to 47 illustrate the many uses of the apparatus 1. In particular, this apparatus 1 allows for reeducation of the lower and upper limbs in a seated, standing, or lying position, depending on the adjustment of the position of the apparatus 1 on the frame; wherein this adjustment is obtained by adjusting the position of the base (not shown) sliding on the frame. With this apparatus 1, the user can exercise, as much as possible, simultaneously both lower and upper limbs; wherein only the connecting means have to be adapted for this kind of exercise.

In general, the apparatus 1 will be used for reeducation or fitness for most of the user's muscles. For this purpose, the user and the apparatus 1 will be positioned in numerous combinations. The user can be either in a lying, a seated, or a standing posture, and the apparatus 1 may be positioned horizontally or vertically or with intermediate inclination.

Figure 38:
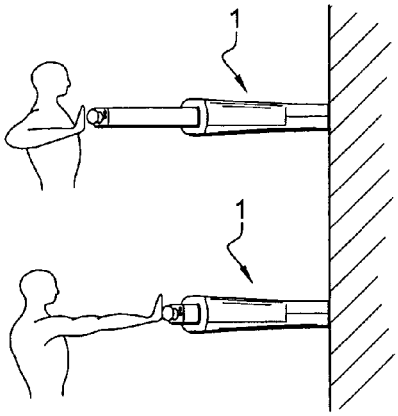
Figure 39:
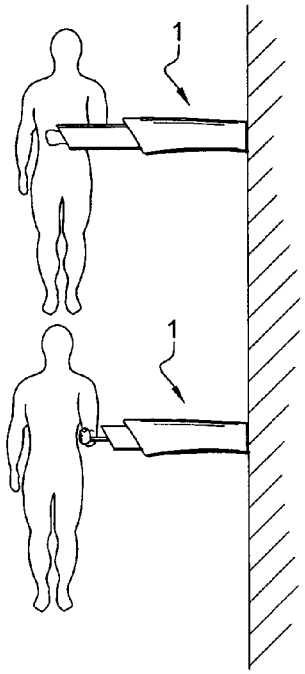
Figure 40:
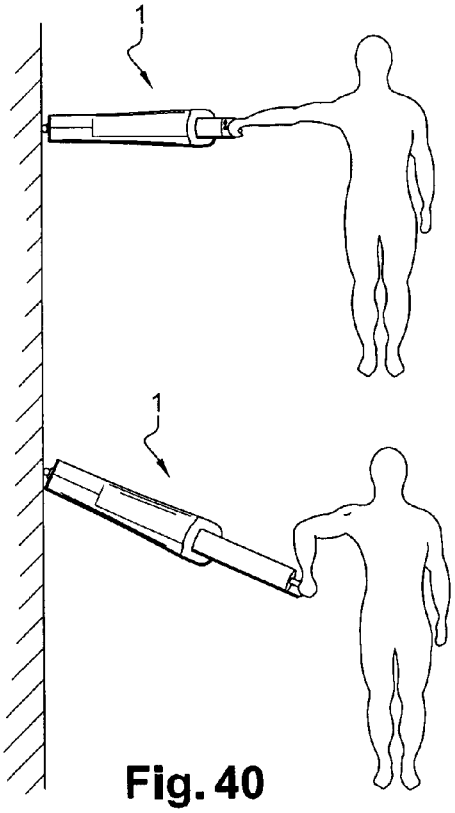

In FIGS. 38 to 39, the user is exercising an upper limb, while standing, with an apparatus 1 bearing against a wall or being hinged to a wall.

Figure 41:
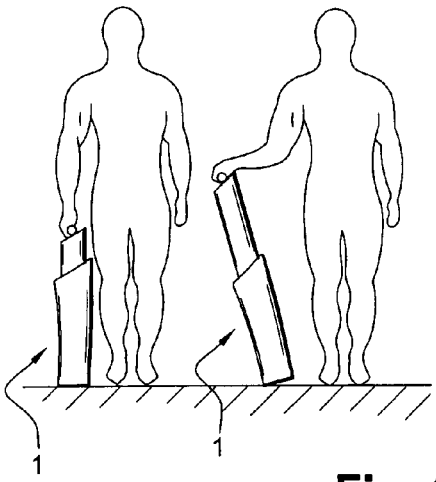

In FIG. 41, the user is exercising an upper limb, while standing, with an apparatus 1 bearing on the floor or being hinged to the floor.

In FIG. 42, the user is exercising a lower limb, while lying down, with an apparatus 1 bearing against a wall or being hinged to a wall.

In FIGS. 43 and 44, the user is exercising a lower limb, while standing, with an apparatus 1 bearing against a wall or being hinged to a wall.

In FIG. 45, the user is exercising a lower limb, while being seated, with an apparatus 1 bearing against a wall or being hinged to a wall.

Figure 46:
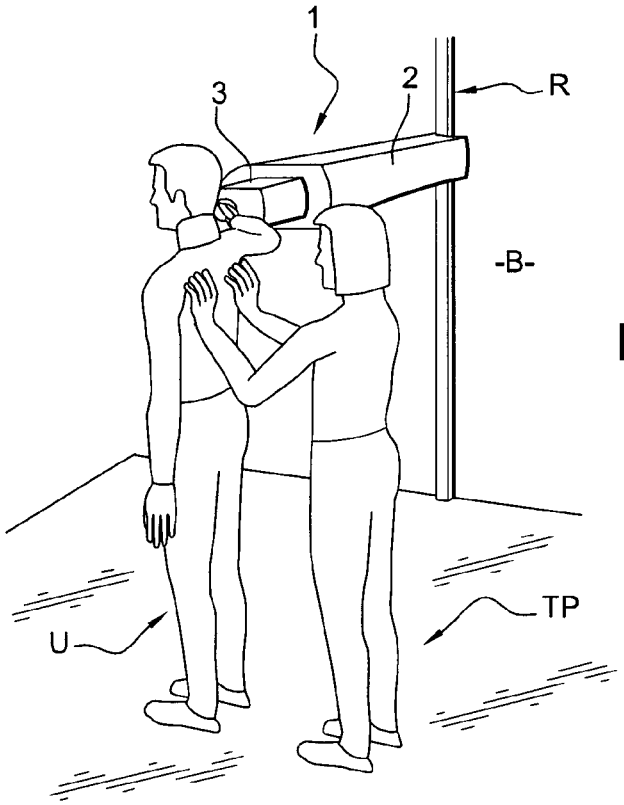
FIGS. 46 and 47 each illustrate a user of an apparatus in accordance with the invention with a third party such as a therapist or a sports trainer.
Figure 47:
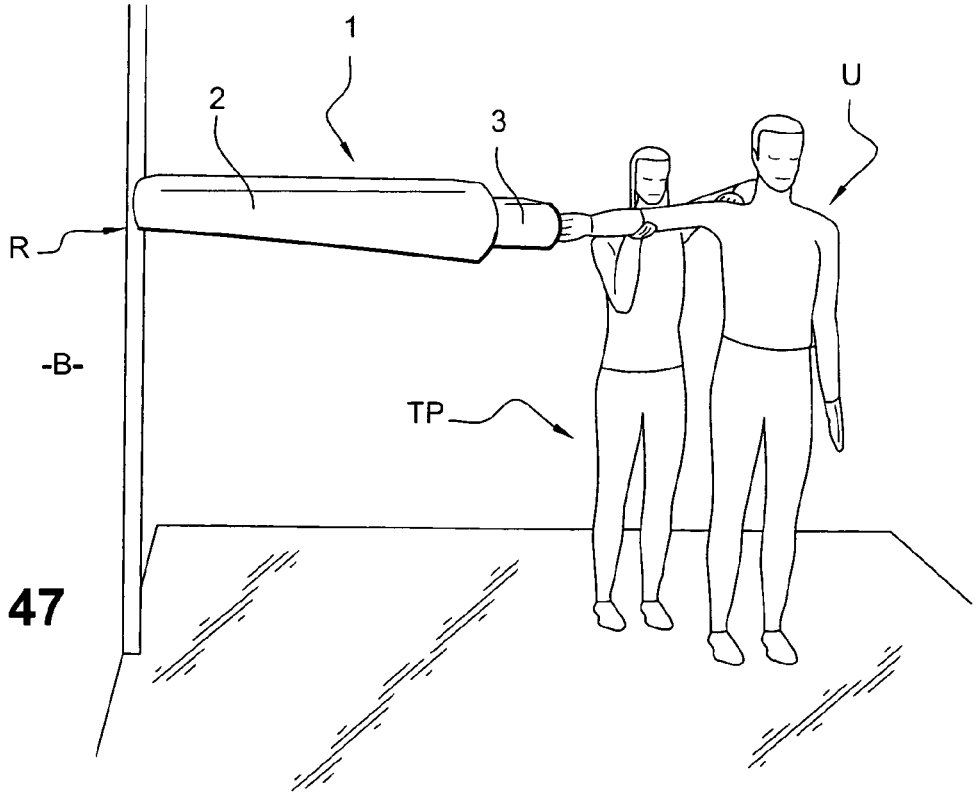
Figure 46A:
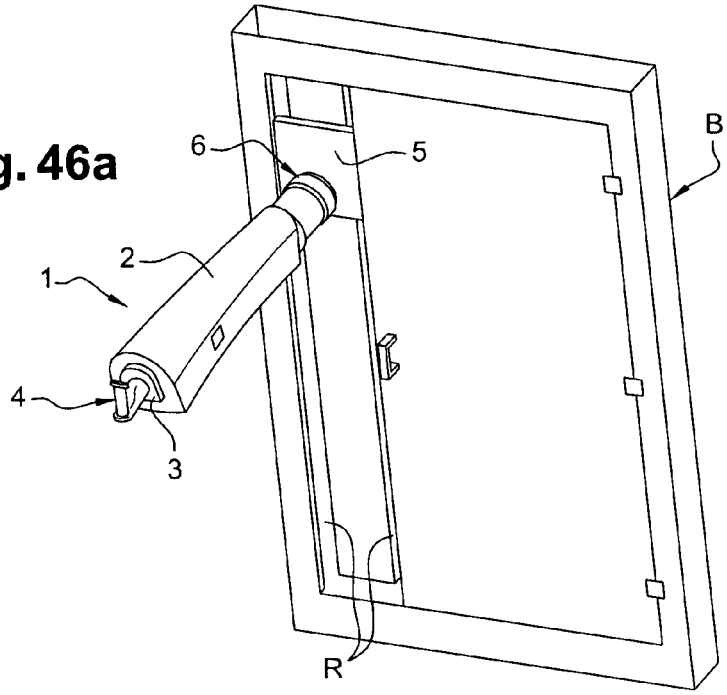
FIGS. 46*a* and 46*b* respectively are schematic perspective and side views of an exercise device in accordance with the invention comprising an apparatus in accordance with the invention removably installed on a frame.
Figure 46B:
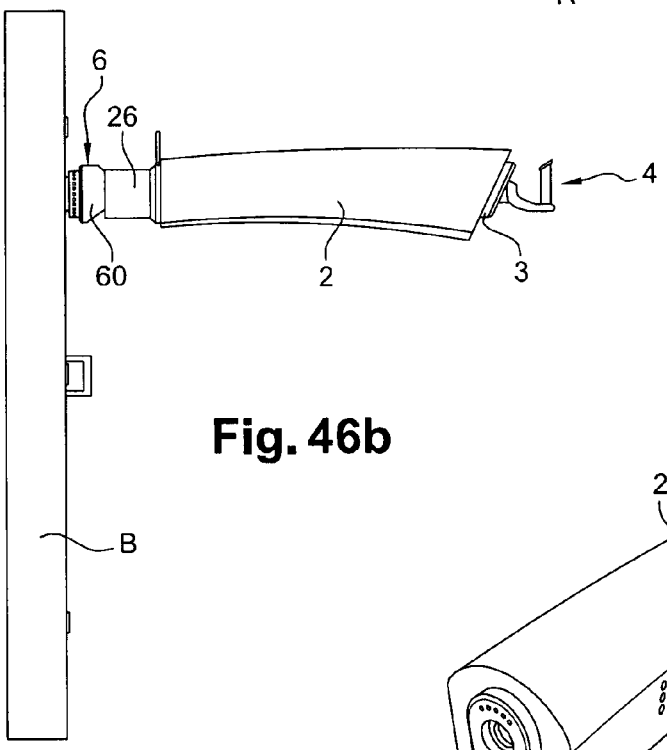

In FIGS. 46 and 47, the user U is exercising an upper limb, while standing, with an apparatus 1 adjusted to a practical height after adjusting the position of the base (not shown) on a rail R integral with frame B (here a wall), and with a third party TP, as for example a therapist or sports trainer, managing the exercise.

With such an apparatus 1, it is to be noted that:

- the third party TP may have access to the user U almost over 360 degrees, i.e. he/she may turn around the user U, namely for analyzing the posture and possibly correcting the posture before or during the exercise with the apparatus 1,
- the third party TP may act directly, with both hands free, on the user U, in particular for correcting unbalance, eliminating or modifying stray movements, guiding the user U in the movement (be it in terms of path, effort, speed, etc.), supporting or physically holding the limb being exercised.

This apparatus 1 allows for instance for eccentric and concentric movements to be performed, depending on the muscle chain involved.

Furthermore, this apparatus 1 has the advantage of being transportable or portable, compact or lightweight, so that a user can easily move therewith, and above all, a therapist or sports trainer can visit a patient or client with the apparatus.

Of course, the sample implementation mentioned above is absolutely not restrictive, and further details and improvements may applied to the apparatus according to the invention without leaving the scope of the invention wherein other forms of motor-driven means and/or secondary motor-driven means and/or hinge and/or mobile members can be embodied for instance.

The invention claimed is:

1. An apparatus for muscle and joint exercise, adapted to reeducation and/or physical conditioning of a body part of a user, said apparatus comprising:

a hollow body, open at one of the ends thereof and having a bottom at the end opposite the open end, said body being elongated along a main axis and said bottom of the body being removably mounted on a base slidingly mounted in a frame;

a mobile member comprising an elongated arm slidingly mounted inside the body and translatable inside the body along said main axis and said arm going through the open end of said body, said arm being movable between a retracted position and a deployed position and being designed to be displaced by the body part of the user and also for displacing said body part;

a motor-driven system comprising a motor arranged inside a case fastened to said bottom of the body, said motor being connected to the arm and adapted for driving in displacement the arm in both translatory directions, and also for decelerating displacement of the mobile member in both translatory directions; wherein the mobile member is not a telescopic arm and the arm has two opposite ends, a first free end on which a connecting member is arranged so that the user can both pull and push the arm and so that the user can both be pulled and pushed by the arm, and a second end connected to the motor, and wherein the body has a length comprised between 700 and 1500 mm and the arm has a maximum translatory stroke comprised between 500 and 1000 mm;

a plurality of guiding elements arranged inside the body and fastened to said body, said guiding elements being configured for guiding said arm in the translator movement thereof and for sustaining the radial efforts perpendicular to the main axis;

wherein the guiding elements provide a substantially isostatic guiding of the arm by comprising several tie bars extending inside the body in parallel to the main axis, and at least one slide slidingly mounted on each of said tie bars and fixedly mounted on the arm, said tie bars respectively comprising a back end fastened to the case of the motor;

at least one hinge configured for articulating the body on the frame, said hinge being arranged on the bottom of the body and providing at least one degree of rotational freedom for the body around an axis of rotation.

2. The apparatus according to claim 1, wherein the hinge is designed for providing two degrees of rotational freedom around respectively two axes of rotation perpendicular to each other.

3. The apparatus according to claim 2, wherein the hinge comprises a first pivot link along the main axis connected to a second pivot link along a transverse axis perpendicular to the main axis.

4. The apparatus according to claim 1, wherein each hinge further comprises at least one adjustable stop limiting rotation of the body around at least one axis of rotation, so that said stop allows to define an angular range adjustable for the rotation of said body around the corresponding axis of rotation.

5. The apparatus according to claim 1, wherein the body supports at least one secondary motor-driven system comprising a motor coupled to the body for rotationally driving the body around an axis of rotation, said secondary motor-driven system comprising at least one angle sensor around the axis of rotation thereof.

6. The apparatus according to claim 1, wherein the motor-driven system comprises:

a motor provided for four-quadrant operation;

a reversible power supply of the motor; and a reversible converting device configured for reversibly converting an output movement of the motor into a translatory displacement of the arm.

7. The apparatus according to claim 1, wherein the motor-driven system comprises a rotary motor, a threaded shaft rotatingly driven by the motor and a nut part provided with a threaded orifice cooperating with the threaded shaft, and wherein the nut part is integral with the slide.

8. A muscle and joint exercise device adapted for reeducation and physical conditioning of a body part of a user, said device comprising:

an exercise apparatus according to claim 1; and a frame in which a base is slidingly mounted;

wherein the body is removably mounted on said base so as to allow for the position of the apparatus to be adjusted by adjusting the position of the base on the frame.

9. A method for using an exercise apparatus including the following steps:

providing an apparatus having a hollow body, open at one of the ends thereof and having a bottom at the end opposite the open end, said body being elongated along a main axis;

providing a mobile member comprising an elongated arm slidingly mounted inside the body and translatable inside the body along said main axis and said arm going through the open end of said body, said arm being movable between a refracted position and a deployed position and being designed to be displaced by the body part of the user and also for displacing said body part;

providing a motor-driven system having a motor arranged inside a case fastened to said bottom of the body, said motor being connected to the arm and adapted for driving in displacement the arm in both translatory directions, and also for decelerating displacement of the arm in both translatory directions, wherein the mobile member is not a telescopic arm and the arm has two opposite ends, a first free end on which a connecting member is arranged so that the user can both pull and push the arm and so that the user can both be pulled and pushed by the arm, and a second end connected to the motor, and wherein the body has a length comprised between 700 and 1500 mm and the arm has a maximum translatory stroke comprised between 500 and 1000 mm;

providing a plurality of guiding elements arranged inside the body and fastened to said body, said guiding elements being configured for guiding said arm in the translator movement thereof and for sustaining the radial efforts perpendicular to the main axis, wherein the guiding elements provide a substantially isostatic guiding of the arm by comprising: several tie bars extending inside the body in parallel to the main axis, and at least one slide slidingly mounted on each of said tie bars and fixedly mounted on the arm, said tie bars respectively comprising a back end fastened to the case of the motor;

providing at least one hinge configured for articulating the body on a frame, said hinge being arranged on the bottom of the body and providing at least one degree of rotational freedom for the body around an axis of rotation;

removably mounting the body of the apparatus on a base slidingly mounted in the frame; and adjusting a position of the apparatus by adjusting a position of the base on the frame.

10. The method according to claim 9, further comprising a control method of the apparatus comprising the following steps performed by a control unit or central processing unit integrated in the exercise apparatus:

a) recording or inputting at least one set-point curve corresponding to a predefined variation of a main exercise parameter predetermined depending on a status parameter which is a time or a displacement of the arm, said main exercise parameter representing effort of displacement imposed by the arm on said body part or vice versa, and selected from a force produced by the user on the arm for displacing or decelerating the mobile member, a torque or force produced by the motor-driven system for displacing or decelerating the arm, a speed of displacement of the arm and an acceleration of the displacement of the arm, wherein said control system comprise, to perform such step a), a storage means adapted for recording set-point curves, and a transfer means for transferring set-point curves recorded at a terminal or an external storage means to the storage means of the apparatus;

b) acquiring an actual curve corresponding to a variation of the main exercise parameter measured during the exercise depending on the status parameter, wherein said control system comprise, to perform such step b), at least one first sensor for measuring, during the exercise, the actual main exercise parameter, and at least one second sensor for measuring, during the exercise, the actual status parameter, said sensors being connected to said central processing unit;

c) controlling the motor-driven system so as to regulate the actual curve around the set-point curve during the exercise, wherein said control system comprises, to perform such step c), a comparator for comparing the set-point curve saved in the storage means with the data from said sensors, and a corrector or regulator controlling the motor-driven system to compensate an output signal of the comparator corresponding to the difference or the error to compensate so as to carry out the regulation.

11. The method according to claim 10, wherein the control method further comprises the following steps:

d) during the exercise, measuring at least one set-point parameter selected from:

a secondary exercise parameter distinct from the main exercise parameter, said secondary exercise parameter representing the effort of displacement imposed by the arm on said body part or vice versa, and selected from the force produced by the user on the mobile member for displacing or decelerating the arm, the torque or force produced by the motor-driven system for displacing or decelerating the arm, the speed of displacement of the arm, and the acceleration of the displacement of the mobile member;

a physiological parameter representing the physiological state of the subject, and selected from electromyographic activity, respiration rate, heart rate, the user's temperature, blood oxygen level, blood pressure, and perspiration;

a duration parameter representing the duration of the exercise, and selected from the duration of the exercise, the number of displacement cycles carried out by the mobile member, the time required for the user to carry out one or several predetermined displacements of the mobile member;

an environmental parameter representing the external environment in which the user is carrying out the exercise, and selected from external ambient temperature, external level of humidity, external ambient pressure;

wherein said control system comprises, to perform such step c), at least one third means for measuring the set-point parameter(s), said third means being connected to the central processing unit;

e) during the exercise, comparing the at least one set-point parameter with at least one predefined threshold value;

f) modifying or replacing the set-point curve if, in step e), at least one set-point parameter is greater or smaller than the corresponding threshold value, before resuming steps b) to e) with the set-point curve as modified or replaced so as to adapt the exercise to the user according to an exercise protocol predefined depending on the progress of at least one set-point parameter.

12. The method according to claim 10, wherein the control method comprises a step of receiving at least one order issued by the user or a third party, and a step of modifying or changing the set-point curve depending on said order so as to modify the current exercise or replace the current exercise with another exercise, wherein said control system comprises, to perform such a receiving step, a means for receiving an order connected to the central processing unit.

13. The method according to claim 10, wherein the control method comprises a step of locating the arm in space, and a step of steering the position of the arm in space so as to oblige the user to follow, with the arm, a delimited path in space during the exercise, wherein said control system comprises, to perform such a locating step, angle sensors and a displacement sensor measuring the displacement of the arm.

* * * * *